US010451378B2

(12) United States Patent
Vabnick et al.

(10) Patent No.: US 10,451,378 B2
(45) Date of Patent: Oct. 22, 2019

(54) REVERSE VELOCITY JET TAMPER DISRUPTER ENHANCER

(71) Applicant: Federal Bureau of Investigation, Washington, DC (US)

(72) Inventors: Ian B. Vabnick, Quantico, VA (US); Thomas A. Sharkey, Quantico, VA (US); Joseph Santiso, Quantico, VA (US)

(73) Assignee: THE UNITED STATES OF AMERICA AS REPRESENTED BY THE FEDERAL BUREAU OF INVESTIGATION, DEPARTMENT OF JUSTICE, Washington, DC (US)

( * ) Notice: Subject to any disclaimer, the term of this patent is extended or adjusted under 35 U.S.C. 154(b) by 0 days.

(21) Appl. No.: 15/896,760

(22) Filed: Feb. 14, 2018

(65) Prior Publication Data

US 2019/0249944 A1 Aug. 15, 2019

(51) Int. Cl.
*F41B 9/00* (2006.01)
*F42B 33/06* (2006.01)

(52) U.S. Cl.
CPC ..... *F41B 9/0075* (2013.01); *F41B 9/0046* (2013.01); *F42B 33/062* (2013.01)

(58) Field of Classification Search
CPC ..... F41B 9/0075; F41B 9/0046; F41B 9/005; F41B 9/0053
See application file for complete search history.

(56) References Cited

U.S. PATENT DOCUMENTS 2,738,962 A * 3/1956 Goodrie ..... B01F 5/0403 137/218
4,957,027 A 9/1990 Cherry
5,134,921 A 8/1992 Breed et al.
6,269,725 B1 8/2001 Cherry
6,439,127 B1 8/2002 Cherry
6,490,957 B1 12/2002 Alexander et al.
(Continued)

FOREIGN PATENT DOCUMENTS

GB 2030684 * 4/1980

OTHER PUBLICATIONS

U.S. Appl. No. 15/731,874, filed Aug. 18, 2017.

*Primary Examiner* — Stephen Johnson
(74) *Attorney, Agent, or Firm* — Leydig, Voit & Mayer, Ltd.

(57) ABSTRACT

Provided herein are fluid jet enhancement adapters for use with a propellant driven disrupter. The adapter may comprise: a first end operably connected to a muzzle end of a propellant driven disrupter barrel and a second end, wherein a longitudinal region extends between the first end and the second end. The longitudinal region has: a longitudinal region inner surface that defines a longitudinal region lumen; a longitudinal region outer surface opposably facing the longitudinal region inner surface, with a longitudinal region wall having a wall thickness that separates the longitudinal region inner surface from the longitudinal region outer surface. The longitudinal region lumen has a first end inner diameter that is substantially equivalent to a muzzle inner diameter. The longitudinal region wall forms a continuous surface that radially isolates the longitudinal region lumen from a surrounding environment.

23 Claims, 15 Drawing Sheets

(56) References Cited

U.S. PATENT DOCUMENTS

| | | | | |
|---|---|---|---|---|
| 6,896,204 | B1 | 5/2005 | Greene et al. | |
| 7,228,778 | B2 * | 6/2007 | Edwards | F41A 25/02 42/1.06 |
| 7,481,146 | B2 | 1/2009 | Weiss | |
| 7,533,597 | B1 | 5/2009 | Strohman | |
| 8,196,513 | B1 | 6/2012 | O'Rourke | |
| 8,245,430 | B1 * | 8/2012 | Owenby | F41A 19/69 42/84 |
| 8,839,704 | B2 | 9/2014 | Baum | |
| 9,429,408 | B1 | 8/2016 | Chamberlain et al. | |
| 9,587,909 | B1 * | 3/2017 | Askin | F41F 1/00 |
| 2002/0096079 | A1 | 7/2002 | Alford | |
| 2017/0138713 | A1 | 5/2017 | Penrod | |

* cited by examiner

REVERSE VELOCITY JET TAMPER DISRUPTER ENHANCER

STATEMENT OF GOVERNMENT INTEREST

The inventions described herein were invented by employees of the United States Government and thus, may be manufactured and used by or for the U.S. Government for governmental purposes without the payment of royalties.

BACKGROUND OF INVENTION

In the art of hazardous devices access and disablement, including explosive ordnance disposal, a common tool, particularly for neutralizing improvised explosive devices (IEDs), is the propellant driven disrupter, also generally and colloquially referred to as a "water cannon". A propellant driven disrupter may be used to fire a solid projectile or a jet of fluid, which is typically water, at an IED with the goal of disrupting the explosive and avoiding its detonation. A solid projectile may penetrate tougher casing materials. On the other hand, a jet of water has considerable mass and momentum and acts upon the target explosive for a longer duration than does a solid "slug" projectile. The water may penetrate into the IED and separate components such as the fuzing system and firing train, without requiring precise aiming due to the large cross section of the water jet. Additionally, a jet of water has a reduced risk of initiating an explosive due to shock, compared to a solid projectile.

A significant limitation of fluid jets, particularly of water jets, is that they can rapidly disperse and break up into a cloud of droplets, referred to as atomization, as a result of the combination of dynamic forces acting upon the water jets. Atomization of the water jet reduces the length and mass of the water jet, which limits the momentum and energy transfer to the target IED and limits the duration of the action. This reduces the effectiveness as well as the reliability of IED disruption when using water jets. Thus, there is a need in the art to address these limitations and to provide a reliable platform for neutralizing a wide range of IEDs, over a wide range of situations, including various device and environmental conditions. Provided herein are specially designed adapters, and associated methods, for use with propellant driven disrupters which improve the effectiveness and reliability of fluid jets propelled from disrupters to perforate and disable IEDs or to aid in a breach of a structure.

SUMMARY OF THE INVENTION

Provided herein are methods and systems for improving the effectiveness of liquid propellant driven disrupters by specially stabilizing, improving and/or more precisely controlling desired characteristics of the expelled fluid jet. This is accomplished by providing a specially configured tubular extension, referred generally herein as an "adapter", that is connected to the muzzle end of the disrupter. The adapter may be designed to retro-fit a conventional disrupter. The extension may be sold after-market or may be packaged and sold with the disrupter, or may be incorporated by a manufacturer or supplier into new disrupter models. For example, new disrupter models may incorporate the instant technology by having extended barrels, but during use filled to such a level so as to produce the enhancement benefits of the adapter.

The adapters described herein provide a number of functional benefits with respect to a well-controlled and stabilized expelled fluid jet, including increased stand-off distance, improved target penetration (e.g., increased penetration depth), and improved impulse characteristics, with respect to a target such as an improvised explosive device (IED). These functional benefits can result in a significantly reduced risk of an unwanted shock-initiated explosive event. In addition, the adapter provides a platform for breaching through a wide range of materials, such as walls, windows, doors, vehicle bodies and windshields. Such materials can provide a challenge for conventional disrupters without the adapters described herein. For example, those materials positioned between the disrupter and explosive target can substantially affect the fluid jet, decreasing momentum and energy, such that, upon finally reaching the target, the fluid jet is ineffective at reliably and safely destroying the explosive target. In some cases, the breach is the primary objective to afford access to tactical teams.

The devices and methods provided herein accomplish these functional benefits by addressing the fundamental fluid dynamics problem of expelling liquid from a propellant driven disrupter, where the back-end of the fluid, also referred herein as the "proximal fluid end", has a higher acceleration than the front-end, also referred herein as the "distal fluid end". This configuration of differential fluid accelerations and resultant velocity differences is referred herein as a "reverse velocity gradient" and was first observed by Christopher Cherry, Sr (circa 1992). Accordingly, upon exit of the disrupter barrel, the expelled fluid jet tends to undergo rapid fluid-jet breakup, such as by atomization. By incorporating or connecting an adapter described herein to the muzzle end of the barrel, the distal fluid end is accelerated and the acceleration of the proximal fluid end is hampered, to thereby effectively disrupt the conventional reverse velocity jet gradient.

Provided herein are fluid jet enhancement adapters for use with a propellant driven disrupter. The adapter may comprise: a first end operably connected to a muzzle end of a propellant driven disrupter barrel and a second end, wherein a longitudinal region extends between the first end and the second end. The longitudinal region has: a longitudinal region inner surface that defines a longitudinal region lumen; a longitudinal region outer surface opposably facing the longitudinal region inner surface, with a longitudinal region wall having a wall thickness that separates the longitudinal region inner surface from the longitudinal region outer surface. The longitudinal region lumen has a first end inner diameter that is substantially equivalent to a muzzle inner diameter (inner diameter at the muzzle end of the disrupter barrel). The wall forms a continuous surface that radially isolates the longitudinal region lumen from a surrounding environment.

The adapter may be connected to a disrupter by any one or more connection mechanisms. Any of the adapters provided herein may further comprise a means for connecting the adapter to a disrupter barrel. The means may comprise a connector, such as a connector positioned at or extending from the first end. The connector may have threads or grooves in a portion of the connector outer surface or connector inner surface, such as to physically and reliably connect to another correspondingly threaded or grooved connection element, for example at the muzzle end of the disrupter barrel. For example, the disrupter barrel may have threads or grooves on its outer surface for rotationally mating with the connector of the adapter.

The adapters provided herein are compatible with a range of connection mechanism types and configurations, and need not be limited to any specific mechanism. For example, the connector may comprise a clamp, a fastener, or a collet, that when tightened, reliably secures and holds the adapter to the disrupter barrel, including so that the components continue to remain connected even for repeated use and exposure to explosive expulsion of the fluid projectile out of the barrel. The threaded connector may slide over the barrel and be clamped to the barrel. The rotational mating occurs between the threaded clamp and adapter such that any conventional barrel may be retrofitted without machining or modification of the conventional barrel.

A proximal-most portion of the connector outer surface may comprise grooves and a kerf cut and the collet may further comprise a nut having an inner threaded surface configured to rotationally mount to the connector outer surface and decrease a proximal lumen diameter similar to a compression fitting. The proximal lumen diameter may be configured to receive a distal portion of the muzzle.

The adapter may have a resting proximal lumen diameter that is greater than the longitudinal region lumen first end inner diameter, wherein the resting proximal lumen diameter is configured to accommodate the distal portion of the muzzle (e.g., outer surface of the distal portion of the muzzle end of the disrupter barrel) and tighten with the nut to provide the proximal lumen diameter that is substantially equivalent to the muzzle inner diameter.

Any of the adapters provided herein may further comprise a connector configured to retro-fit a conventional disrupter, thereby improving one or more fluid-jet parameters.

The adapter may be further described in terms of one or more structural features. The structural features may be tailored to the application of interest. For example, an adapter may be tailored to a specific conventional disrupter, including a Percussion Actuated Non-electric (PAN) disrupter or a water jet cannon.

The longitudinal region of the adapter may have a length that is between 20% and 200% of a fluid-projectile length that is positioned in the barrel before firing. The fluid-projectile length need not be equivalent to the disrupter barrel length, but can be less than or greater than the disrupter barrel length, depending on the target of interest. The disrupter barrel may be filled with fluid and capped or plugged to prevent unwanted fluid leakage. Accordingly, the length of the fluid-filled portion of the disrupter barrel, also referred herein as the fluid projectile length, may be less than the total disrupter barrel length. A fluid projectile may be encapsulated within a cylindrical container that tight fits in the barrel lumen. For example, the fluid projectile may correspond to any of the fluid projectiles described in U.S. patent application Ser. No. 15/731,874 filed Aug. 18, 2017 to Vabnick et al. and titled "DISRUPTER DRIVEN HIGHLY EFFICIENT ENERGY TRANSFER FLUID JETS"; referred herein as a highly efficient energy transfer (HEET) fluid projectile, and may include high viscosity liquids with solid particles suspended therein. In other words, the adapters described herein are compatible with a range of fluid projectile types, including liquid pored directly in the barrel lumen, liquid phase and solid phase mixtures, and liquid-based projectile within an encapsulation container that is positioned in the barrel lumen.

For example, a PAN-type disrupter with a 21.75 inch long bore may be filled with fluid and plugged/capped, or an encapsulated fluid projectile may be inserted into the barrel, such that the fluid projectile length is 18.75 inches, for example. The adapter longitudinal region length may be 5 inches, for example, such that the adapter's longitudinal region length is approximately 26.7% of the fluid-projectile length. The ratio of adapter longitudinal region length to fluid-projectile length may be approximately 0.267, and may vary between 0.1 and 1, or between about 0.2 and 0.4, or any sub-ranges thereof, depending on the specific application.

Any of the adapters described herein may have a longitudinal region lumen that is tapered. The taper geometry may be described in terms of a length and/or angle. The taper length and angle may be selected such that the resultant minimum lumen inner diameter at any point in the adapter is greater than or equal to 25%, 50%, 75%, 80%, 85%, 90%, or 95% of the muzzle end inner diameter. The taper may range from 1° to 5° and may be constant and continuous. For example, the taper may range over the entire length of the longitudinal region of the adapter. For example, the minimum longitudinal region lumen inner diameter is at the second end of the longitudinal region of the adapter. Alternatively, the taper may span a sub-region of the adapter, such as the distal-most 95%, 90%, 75%, or 50% portion of the adapter. In this manner, the taper is configured to accelerate the fluid jet, thereby increasing the fluid jet velocity and fluid jet length. Increased jet velocity and length can increase penetration depth, increase stand-off distance, and improve barrier limit capability to overcome barrier materials and geometries that otherwise tend to be problematic for conventional disrupters. Such a taper can harness the Venturi effect, which acts upon the entire length of the jet in a uniform fashion and can accelerate the jet by a factor equal to the ratio of the muzzle end inner diameter to adapter orifice diameter. A long and uniform taper tends to minimize unwanted turbulence effects.

Any of the adapters provided herein may have the first end inner diameter within 10%, 5%, 1% or 0.1% of the disrupter muzzle end inner diameter.

Any of the adapters provided herein may be configured to incorporate or connect to an accessory, including a fluid-jet accessory. For example, the adapter second end may have a threaded outer surface configured to receive the fluid-jet accessory, including by screwing the accessory onto the adapter second end.

The fluid-jet accessory may be a Venturi tip nozzle, a suppressor, or a combination thereof. The Venturi tip may be constant and continuous and reduce the inner lumen by no more than 25% of the barrel or adapter barrel diameter.

Also provided herein is a rammer that is configured to displace a measured amount of fluid from the barrel and to seat a fluid sealing plug at the tip of the fluid projectile. The rammer can be selected to have a length that extends through the adapter attached to the disrupter barrel, and into the disrupter barrel, thereby displacing the appropriate amount of fluid to achieve a desired fluid projectile length. Alternatively, the rammer may be used before attaching the adapter to the disrupter barrel, so as to similarly result in a desired projectile length. The rammer may comprise a plurality of sections, with adjacent sections telescopingly connected to each other, so that the rammer has a user-adjustable length to provide a desired fluid projectile length in the disrupter barrel.

Any of the adapters provided herein may be configured to provide an improvement in a fluid jet parameter compared to a corresponding conventional disrupter without the adapter connected thereto. The improved fluid jet parameter may be one or more of increased stand-off distance by up to 800%, increased penetration depth by up to 200%, and increased average jet tip velocity by up to 200% while simultaneously dropping the rear of the jet's velocity such that it is approximately the same value as the jet tip velocity. For example, the difference in fluid velocity at the rear and tip may be quantifiably described, such as within 5% to 20% of the jet tip, as the fluid jet tip exits the barrel, or any sub-ranges thereof. The rear of the jet may be greater than 155% faster without the Reverse Velocity Jet Tamper (ReVJeT) disrupter adapter for a standard disrupter (PAN). Selecting appropriate fluids provides improved velocity matching. For example, the velocity may be within 5% for HEET fluids, or within 20% for water. The jet tip at nominal standoff produces impact pressures increasing up to 115%. An IED barrier fails quickly at higher jet tip pressures and thus less fluid is wasted perforating the IED. Because the velocity within the fluid column is normalized, and the reverse velocity gradient is reduced, the peak pressures are reduced. Explosive impact tests show no ignition whereas a disrupter without the adapter causes explosive ignition of some explosive types due to excessive impact pressures. The fluid jet is observed to have fewer rarefaction waves which are observed as rings of water spray in high speed video recordings (compare, e.g., FIGS. 17A and 17B). The rarefaction waves are damped because the fluid remains confined longer. HEET jets from PANs captured by high speed video have minimal to no observed rarefaction waves.

Any of the adapters provided herein may be used in a method of reducing the reverse velocity gradient of a fluid projectile ejected from a disrupter barrel. The method may comprise the steps of: connecting an adapter to a muzzle end of a barrel of the disrupter, wherein the adapter is any of the adapters described herein. For example, the adapter may comprise: a first end operably connected to a muzzle end of a propellant driven disrupter barrel; a second end; a longitudinal region extending between the first end and the second end; wherein the longitudinal region has: a longitudinal region inner surface that defines a longitudinal region lumen; a longitudinal region outer surface opposite the longitudinal region inner surface; and a longitudinal region wall having a wall thickness that separates the longitudinal region inner surface from the longitudinal region outer surface; the longitudinal region lumen having a first end inner diameter that is substantially equivalent to a muzzle inner diameter of the disrupter barrel; and wherein the longitudinal region wall forms a continuous surface that radially isolates the longitudinal region lumen from a surrounding environment. At least a portion of the disrupter barrel is filled with a fluid projectile. The fluid projectile is propelled out of the barrel, such as by an explosive cartridge in the disrupter breech, and into the adapter lumen at the first end and out of the adapter second end in a direction toward a target. The adapter is configured to reduce a projectile fluid velocity gradient in the longitudinal region lumen over the length of the fluid projectile by increasing a distal end fluid velocity and/or decreasing the proximal end fluid velocity. In this manner, fluid jet atomization may be decreased and minimized, thereby enhancing fluid jet integrity, and increasing fluid jet length and/or fluid jet tip velocity.

The method may further comprise the step of selecting an adapter length based on a fluid projectile length, wherein the length of the longitudinal region is 20% to 200% of the fluid projectile length. Desired longitudinal region length may be empirically determined for each disrupter system and fluid projectile composition.

Any of the methods provided herein may be further described in terms of providing an improved jet-fluid parameter compared to an equivalent method without the adapter, wherein the improved jet-fluid parameter may be one or more of increased stand-off distance by up to 800%, increased penetration depth by up to 200%, increased average jet velocity by up to 200%. and increased average jet tip velocity by up to 200% while simultaneously dropping the rear of the jet's velocity such that it is approximately the same value as the jet tip velocity. The jet tip produces impact pressures increasing up to 115%. An IED barrier fails quickly and reliably at higher jet tip pressures and thus less fluid is wasted perforating the IED. Because the velocity within the fluid column is normalized, and the reverse velocity gradient is reduced, the peak pressures are reduced. The specific improved jet parameter and magnitude is obtained by adjusting one or more of the adapter characteristics, including adapter barrel geometry, length, taper, and/or fluid properties.

Any of the methods provided herein may utilize a fluid projectile that is an encapsulated HEET fluid, such as any of the projectiles or fluids disclosed in U.S. application Ser. No. 15/731,874 filed Aug. 18, 2017 to Vabnick et al. and titled "DISRUPTER DRIVEN HIGHLY EFFICIENT ENERGY TRANSFER FLUID JETS".

The fluid projectile may have a length equivalent to a length of the disrupter bore, or a length that is at least 95%, 90%, 80% 60%, or between 50% and 95% of the length of the disrupter bore. One representative example is a fluid column that is 13.75" in a 21.75" length bore, or about 63%.

Any of the adapters disclosed herein are configured to increase the velocity of a distal end of the fluid projectile under confinement in the adapter lumen and/or decrease the acceleration of a proximal end of the fluid projectile relative to the distal end. Any of the adapters disclosed herein are configured to increase the velocity of a distal end of the fluid projectile under confinement in the adapter lumen and/or decrease the acceleration of a proximal end of the fluid projectile relative to the distal end such that the fluid jet distal end velocity within the adapter lumen is within 25%, 20%, 10%, 5%, 1%, or equivalent to the fluid jet proximal end velocity within the adapter lumen.

Any of the adapters disclosed herein are configured such that propelled gas (such as from the breach-portion of the disrupter and explosive-generated propelling force) and fluid of the fluid projectile are confined within the adapter lumen until the propelled gas and fluid exit the adapter at the adapter second end.

The method may further comprise the step of exerting a Venturi effect on the fluid projectile in the adapter lumen, thereby increasing average jet velocity and jet length of the fluid projectile expelled from the adapter second end.

The method may further comprise the step of connecting a suppressor on the adapter second end to reduce a muzzle blast effect on a rear portion of the fluid projectile exiting the second end. Any of the adapters disclosed herein may comprise an accessory such as a suppressor.

Any of the adapters described herein may have a longitudinal region lumen diameter that is equivalent, at all points between the first and second ends, to the disrupter barrel muzzle end inner diameter such that the adapter is configured to be compatible with firing of solid projectiles. This geometry is referred to as the adapter and barrel lumens being in axial alignment. In this configuration, the adapter may be left on the disrupter regardless of whether the barrel is filled with a fluid or solid projectile.

Without wishing to be bound by any particular theory, there may be discussion herein of beliefs or understandings of underlying principles relating to the devices and methods disclosed herein. It is recognized that regardless of the ultimate correctness of any mechanistic explanation or hypothesis, an embodiment of the invention can nonetheless be operative and useful.

DETAILED DESCRIPTION OF THE INVENTION

Figure 1:
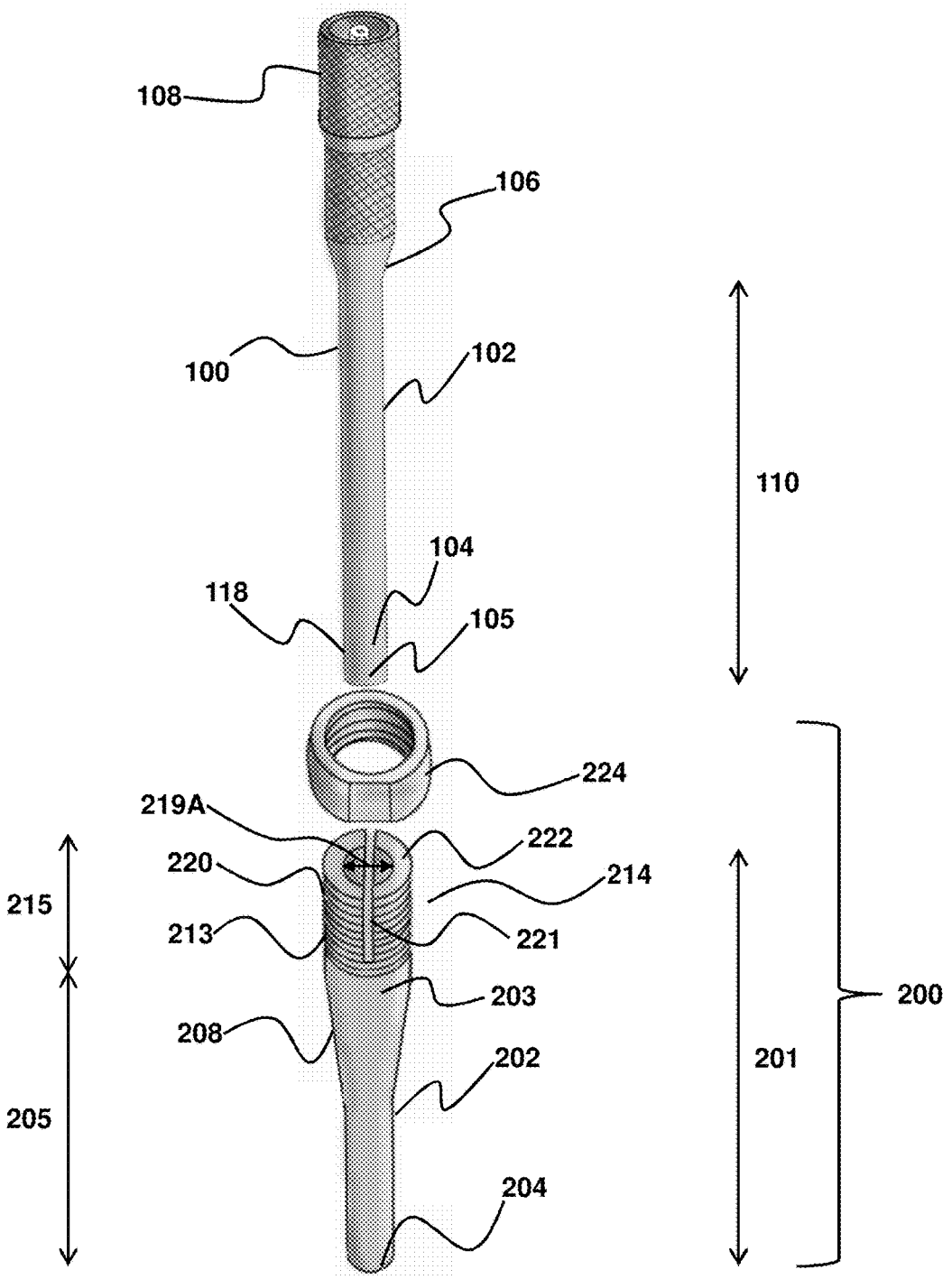
FIG. 1 is an illustration showing a portion of a propellant driven disrupter, including the barrel, and disassembled components of an exemplary fluid jet enhancement adapter.

In general the terms and phrases used herein have their art-recognized meaning, which can be found by reference to standard texts, journal references and contexts known to those skilled in the art. Referring to the drawings, like numerals indicate like elements and the same number appearing in more than one drawing refers to the same element. The following definitions are provided to clarify their specific use in the context of the invention.

The term "breech" refers to the portion of the barrel of the propellant driven disrupter in which an explosive cartridge is positioned.

"Distal" refers to a direction that is furthest from the breech or the explosive cartridge, or that is closest to the to-be-disrupted target. "Proximal" refers to a direction that is toward the explosive cartridge or that is furthest from the to-be-disrupted target.

The term "effective" with regard to a fluid property such as viscosity, density, surface tension refers to an average measure of a property, including for a composite material that is formed of a combination of different materials. For example, a fluid mixture having multiple fluids and/or solid particles can be characterized as having an effective density or viscosity, which is a weighted average or bulk measure of the density or viscosity of the constituents of the fluid mixture. When applied to a fluid property, the term "effective" may refer to a mass-weighted average of the fluid and its constituents. When applied to a fluid property, the term "effective" may refer to a volume-weighted average of the fluid and its constituents. When applied to a fluid property, the term "effective" may refer to a bulk property of the fluid and its constituents.

The term "suspended" with regard to solid particles in a fluid refers to a suspension, or a mixture of solid particles in a fluid wherein the solid particles are thermodynamically favored to precipitate or sediment out of the fluid solution. The suspension may appear uniform, particularly after agitation, (i.e., solid particles macroscopically evenly distributed in the fluid). The suspension is typically microscopically heterogeneous. In an embodiment, solid particles in a suspension are one micrometer or larger in diameter, including up to 1 cm, and any sub-ranges thereof. The solid particles of a suspension may be visible to the human eye. Solid particles in a suspension may appear uniformly mixed, particularly after agitation, but are undergoing sedimentation. The solid particles may remain suspended in the solution on short time scales (e.g., less than one minute) or indefinitely kinetically (i.e., in contrast to thermodynamically). As used herein, solid particles suspended in a fluid may refer to particles fully sedimented (e.g., lead shot particles settled to the bottom of a container with a highly viscous liquid such as syrup that hinders movement of the particles). As desired, a physical barrier may be positioned in the container so as to confine particles to a specific location, particularly for fluids through which the particles may otherwise readily traverse.

The term "dispersed" in regard to solid particles in a fluid refers to a dispersion, or a microscopically homogenous, or uniform, mixture of solid particles in a fluid. Similarly to a suspension, a dispersion may be thermodynamically favored to segregate by sedimentation but wherein sedimentation is kinetically slowed or prevented. As used herein, a dispersion is a microscopically homogenous mixture having solid particles that are less than one micrometer in diameter. One example of a dispersion is a colloid (e.g., milk, tea, and coffee).

The term "jet length" refers to the length of a column of fluid propelled out of a barrel muzzle. As a fluid is propelled out of the disrupter, it tends to disperse and undergo atomization. Thus, jet length may vary with time elapsed since leaving the muzzle and, consequently, vary with the distance from the muzzle.

The term "atomization" refers to the dispersion of the propelled fluid into a cloud of fluid droplets. Atomization is one process that reduces the jet length and integrity. Atomized fluid is not included in the determination of jet length.

The term "jet length at impact" refers to the jet length at the initial moment of impact between the fluid jet and the target.

The term "jet duration" or "fluid jet duration" refers to the time until the fluid is completely atomized or dissipated and no jet, or collimated fluid, remains.

The term "jet impact duration" refers to the total time the fluid jet imparts force or work on the target. The jet impact duration is a function of jet length at impact and jet velocity during impact.

The term "reverse velocity gradient" refers to an explosively propelled fluid in a barrel disrupter having a fluid proximal end having a higher velocity than the fluid distal end, such that upon exit from the muzzle, there is an adverse impacting on one or more fluid jet parameters, resulting in premature jet breakdown and decrease in disruptive power. Provided herein are various fluid jet enhancement adapters and methods that can minimize the reverse jet velocity gradient, thereby improving one or more fluid jet parameters, including by an improvement of a fluid jet parameter by at least 10%, at least 20%, at least 50% or at least 100% compared to the same fluid projectile fired from the same or comparable disrupter but without any of the adapters disclosed herein.

The term "jet fluid velocity" or "fluid jet velocity" is used broadly herein and refers to a characteristic average velocity, such as the average velocity of the entire fluid jet or the average velocity of a leading edge of the jet.

As used herein, the terms "fluid jet", "jet fluid" are used interchangeably to refer to the jet of fluid within the adapter lumen and/or at a point between the disrupter and the target after the fluid or projectile is propelled.

"Volumetric destruction" refers to a disrupted, destroyed, or other physically altered volume of the target by the propelled and target impacted fluid jet. Destruction may be by physical release of material of the volume and/or functional destruction, such as release of a battery from a circuit, disruption of power circuits, or other circuit disruption, where a goal defeating an IED before an unwanted explosion occurs.

As used herein, "cap" and "plug" are used broadly to refer to a physical seal of a container having fluid. The cap or plug may refer to a seal of a container encapsulating a HEET fluid for example, such that an encapsulated fluid may be positioned within the disrupter barrel. The cap or plug may refer to a seal applied within the disrupter barrel or at the muzzle end of the disrupter barrel to seal otherwise un-encapsulated fluid within the disrupter barrel (e.g., a fluid may be poured into the disrupter barrel and then a plug may be applied to seal the fluid within the barrel). A cap may refer to a factory-sealed end or to a material that is inserted into an open end, or a material that covers an open end. Any of the caps may be temporarily punctured to facilitate filling of a container to form, for example, a HEET fluid projectile.

"Operably connected" refers to a configuration of elements, wherein an action or reaction of one element affects another element, but in a manner that preserves each element's functionality. For example, the adapter is operably connected to the muzzle end of the disrupter barrel such that a fluid projectile that is expelled from the disrupter barrel may enter the adapter's longitudinal region lumen without loss of pressure or fluid mass. The connection may be by a direct physical contact between elements. The connection may be indirect, with another element that indirectly connects the operably connected elements.

The terms "directly and indirectly" describe the actions or physical positions of one component relative to another component. For example, a component that "directly" acts upon or touches another component does so without intervention from an intermediary. In contrast, a component that "indirectly" acts upon or touches another component does so through an intermediary (e.g., a third component).

The term "substantially equivalent" refers to one or more properties of two or more elements that are within 10%, within 5%, within 1%, or are equivalent. For example, the diameter of an element A is substantially equivalent to the diameter of an element B if these diameters are within 10%, within 5%, within 1%, or are equivalent.

The term "radially isolates" refers to an adapter barrel wall that prevents release of liquid in a radial direction, and instead forces all fluid out of the adapter distal muzzle end. Accordingly, substantially all fluid that enters the adapter lumen at the first (proximal) end ultimately exists the adapter lumen through the second (distal) adapter end.

The term "conventional disrupter" refers to any commercially-available directional propellant-driven disrupter device having a barrel for ejecting a projectile (e.g., fluid jet) at a target explosive for disruption of said explosive, without an adapter described herein. Exemplary conventional disrupters include Percussion Actuated Non-Electric (PAN), Pigstick, Water Jet Disrupter Cannon, and similar disrupters.

The term "fluid jet parameter" refers to a parameter useful in describing a characteristic or quality of a fluid jet expelled from the disrupter. Exemplary fluid jet parameters include, but are not limited to, jet integrity, jet length, jet impact duration on target, jet velocity, reverse velocity gradient, jet diameter, penetration depth, momentum on target, energy on target, shock pressure time-course, effective stand-off distance, barrier limit, component kill, and explosive impact dynamics. As described, the improvement in fluid jet parameter may be quantified, as appropriate, such as an improvement of at least 10%, 25%, 50% or 100% compared to an equivalent system without a RevJet adapter.

The term "characteristic fluid jet diameter" refers to a measure of a diameter of the fluid jet expelled from the barrel. It may be an average diameter over the discernable length of the fluid jet, or may be a diameter at a defined location over time, such as the distal end (e.g., the jet tip), the proximal end (e.g., the jet rear), or a mid-way point between the leading distal end and the trailing proximal end.

Rarefaction is an art-recognized term referring to the reflection of a pressure wave at an interface due to a shock impedance mismatch. The term rarefaction waves refers to the pressure waves themselves that are moving back and forth in the fluid column and cause a reduction in the density (i.e., opposite of compression) of a fluid or other projectile. The waves cause a loss in fluid mass due to radial (hoop) dispersion and mixing of the fluid with air. The term "rarefaction wave amplitude" refers to the maximum change in density from the mean density.

The term "shock initiation event" refers to an explosion, detonation, or other unwanted failure of the target caused by shock delivered by the projectile (e.g., fluid jet) onto the target (e.g., the target explosive device may detonate as a result of the imparted shock during transfer of energy from the fluid jet to the target device). The term "probability of a shock initiation event" refers to the statistical probability of the projectile (e.g., fluid jet) causing a shock initiation event, for a particular disrupter and projectile system. The probability of a shock initiation event is affected, for example, by the velocity, density, and cross-sectional area of the fluid jet, which is affected by barrel length and adapter length, for example.

The term "stand-off distance" refers to the maximal distance from the target at which the fluid jet may be fired to achieve target disruption safely. The nominal stand-off distance refers to the distance resulting in optimum performance. Generally, the RevJet adapters provided herein facilitate an increase in stand-off distance without adversely impact target disruption.

In the following description, numerous specific details of the devices, device components and methods of the present invention are set forth in order to provide a thorough explanation of the precise nature of the invention. It will be apparent, however, to those of skill in the art that the invention can be practiced without these specific details.

FIGS. 1-8 illustrate exemplary fluid jet enhancement adapters 200 connected to a propellant driven disrupter 100. The propellant driven disrupter 100 may be a conventional disrupter such as a PAN disrupter. Disrupter 100 includes a disrupter barrel 102 having a breech end 106 and a muzzle end 104. The muzzle end is the distal portion 105 of the disrupter barrel. Barrel 102 has a barrel lumen having a barrel lumen inner diameter 112. Barrel 102 has a muzzle end inner diameter 114 and a muzzle end outer diameter 116, defining a muzzle end outer surface 118. Barrel 102 has a barrel length 110. Disrupter 100 also includes a breech 108, which may be loaded with an explosive cartridge 122 (e.g., an explosive blank). Breech 108 may be a proximal portion of barrel 102 or a separate compartment that is operably connected to barrel 102. The lumen of barrel 102 may be loaded with a fluid projectile 300. Fluid projectile 300 may include a plug (or cap) 304 that retains the fluid of fluid projectile 300 at the distal end of fluid projectile 300 within barrel 102. Proximal end 124 of fluid projectile may be similarly capped or sealed. Fluid projectile 300 may be prepared by filling at least a portion of the lumen of barrel 102 with one or more fluids (e.g., water), and then plugging the fluid within barrel 102 with plug 304, optionally using a rammer or ramrod such as rammer 234 (see FIG. 9). Alternatively, fluid projectile 300 may be a partially or fully encapsulated fluid projectile. Fully encapsulated fluid projectile 300, such as HEET fluid, may be loaded into the lumen of barrel 102 such that the wall of barrel lumen 102 does not physically contact a portion of the inner surface of barrel 102.

Figure 2:
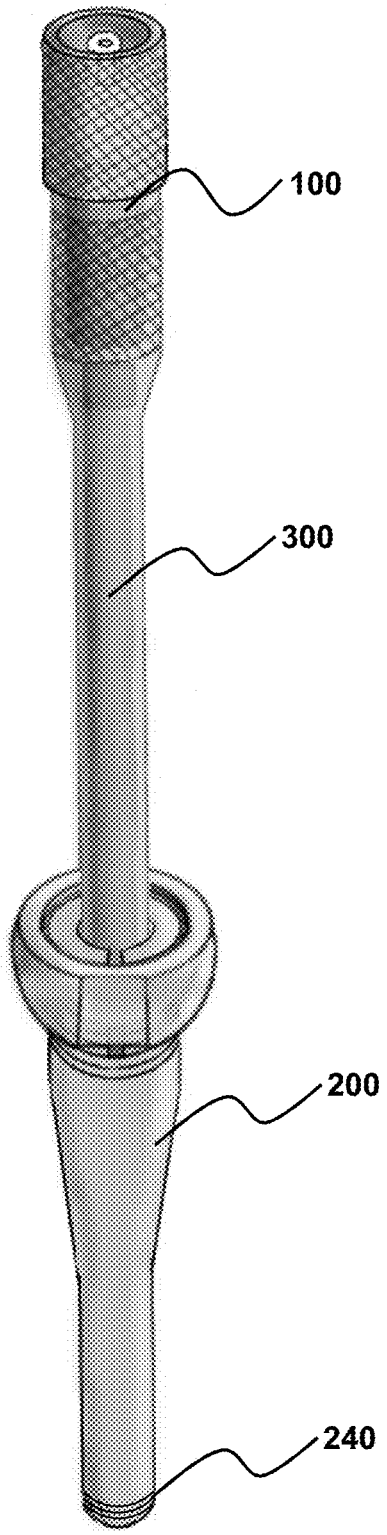
FIG. 2 is an illustration showing the disrupter of FIG. 1 with a fluid projectile therein and the adapter of FIG. 1 operably connected to the disrupter.
Figure 3:
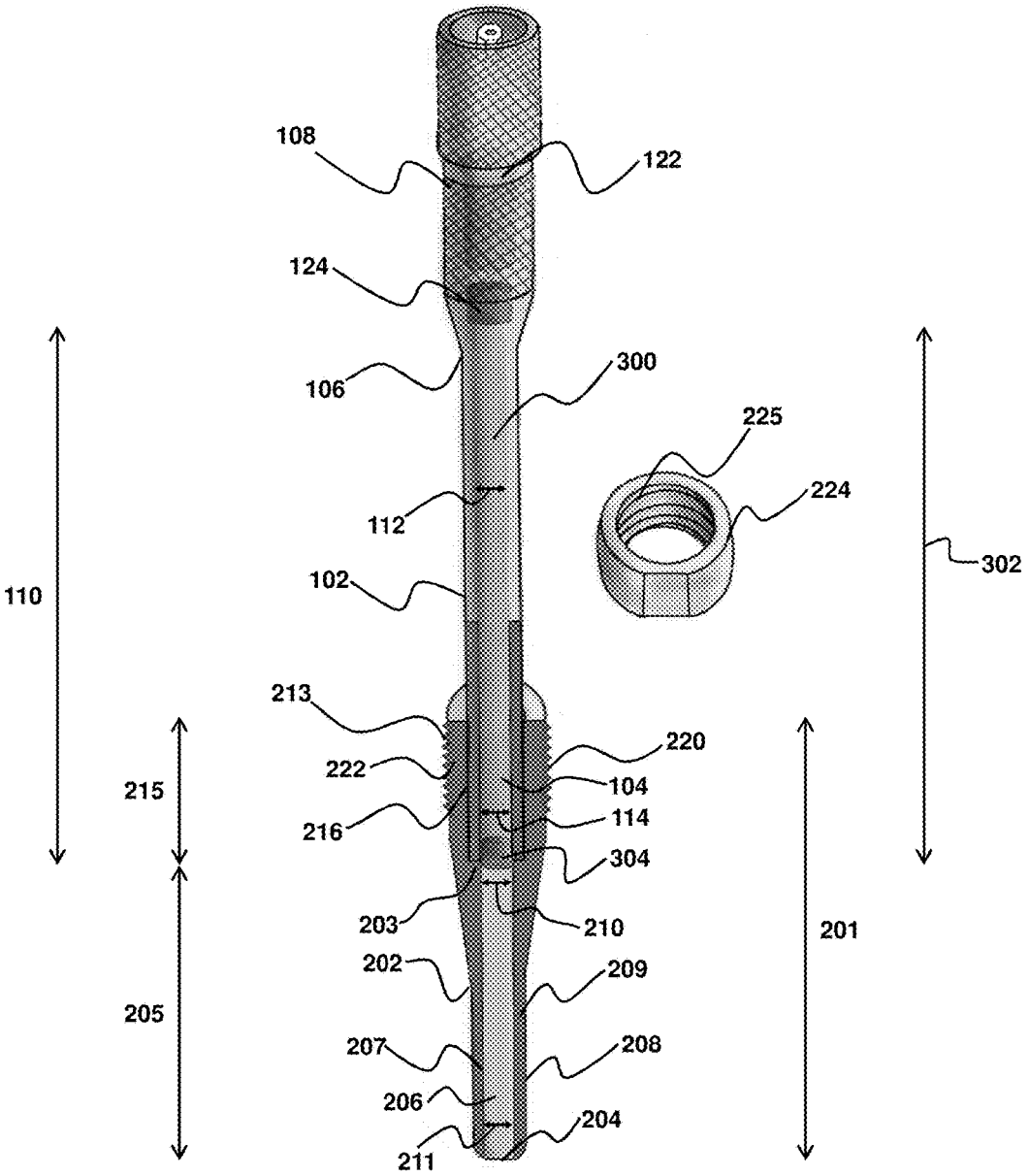
FIG. 3 is a partially cross-sectional illustration of the disrupter and adapter of FIG. 2, with the nut shown separately from the adapter for visual clarity.

FIG. 1 illustrates a disassembled exemplary adapter 200 and a portion of a propellant driven disrupter 100. FIG. 2 illustrates disrupter 100, including fluid projectile 300 therein, and adapter 200 assembled and operably connected to disrupter 100, and FIG. 3 illustrates a partial cross-section of the disrupter 100 and adapter 200 of FIG. 2. Adapter 200 of adapter length 201 includes a longitudinal region 202 that may be operably connected to barrel muzzle end 104 at the first end 203 of longitudinal region 202 (an operably connection is illustrated in FIG. 2). Longitudinal region 202 has a second end 204 where an expelled fluid projectile may exit adapter 200. Longitudinal region 202 has a length 205 between first end 203 and second end 204. Longitudinal region 202 has a longitudinal region lumen 206 having an inner surface 207. A longitudinal region wall 209 separates inner surface 207 from longitudinal region outer surface 208 by a wall thickness 226. Longitudinal region lumen 206 has a first end inner diameter 210 at first end 203 and a second end inner diameter 211 at second end 204.

Adapter 200 may include a connector 213 at or extending from first end 203 of longitudinal region 202. When adapter 200 includes connector 213, adapter length 201 includes longitudinal region length 205 and connector length 215. The exemplary adapter 200 of FIGS. 1-3 includes a connector 213 for mounting onto—or otherwise operably connecting to—muzzle end 104 of barrel 102. At least a portion of connector 213 is a collet 222 which includes two kerf cuts 221. This connector 213 has outer surface 217 having threads or grooves 220. Connector 213 further includes a nut 224 with inner threads or grooves 225 which correspond to threads or groove 220 such that nut 224 may be rotationally tightened onto outer surface 217 of connector 213. Connector 213 further includes a lumen having an inner surface 216. Connector 213 is at proximal region 214 of adapter 200 and proximal region 214 has a resting proximal diameter 219A (inner) which may be greater than proximal lumen diameter 219B (inner). Resting proximal diameter 219A (inner) is selected such that adapter 200 may be secured to the barrel when nut 224 is tightened over at least a portion of collet 222 and outer surface 217, proximal region inner diameter (inner diameter of connector 213) is reduced from resting proximal diameter 219A (inner) to proximal lumen diameter 219B (inner), which provides a compression fit. The proximal lumen diameter 219B (inner) is substantially equivalent to or minimally greater than muzzle end outer diameter 116 in order to tightly (e.g., hand tight) accommodate a portion of muzzle end 104. This exemplary connector 213 forms a friction fit over muzzle end 104.

Any of the adapters described herein may be compatible with a wide range of connection mechanism types and configurations. For example, adapter 200 may include connector 213 that is adapted to connect adapter 200 to a disrupter 100 via a screw-type connection such that connector 213 and muzzle end 104 having corresponding threads (e.g., connector 213 may be screwed onto and over muzzle end 104 having threads at outer surface 118 or connector 213 may be screwed into muzzle end 104 having corresponding threads at the inner surface of muzzle end 104). In another example, connector 213 may be configured to allow adapter 200 to be inserted into muzzle end 104 and held in place via friction. In yet another example, connector 213 may be configured to tightly fit over muzzle end 104 via friction and optionally further tightened via a clamp (i.e., no threads in this example). When adapter 200 is operably connected to disrupter 100, the connection is such that substantially no fluid is lost to a surrounding environment (air) 120 as fluid exits barrel 102 and enters adapter 200 and such that adapter 200 remains connected to barrel 102 after fluid projectile 300 is fully expelled from adapter 200. Adapter 200 may remain operably connected to barrel 102 after at least one, at least two, at least five, or at least ten uses of disrupter 100 (wherein use of disrupter 100 constitutes firing of a projectile). Connecter 213 may have one or more, two or more, three or more, or four or more kerf cuts. Any of the elements and/or portions of connector 213 may be formed of substantially the same material(s) as longitudinal region 202. Any of the elements and/or portions of connector 213 may be formed of different material(s) than longitudinal region 202 (e.g., nut 224, if used, may be formed of a different metal than connector 213 or longitudinal region 202). Optionally, an adhesive may be used between connector 213 and barrel 102. Alternatively, adapter 200 may be operably connected at first end 203 to muzzle end 104 via such that adapter 200 does not include connector 213. In another example, adapter 200 may be operably connected to muzzle end 104 via a tongue and groove type connection mechanism, wherein connector 213 is formed as a radially configured tongue and muzzle end 104 includes a corresponding radial groove, or vice versa. A clamp and/or an adhesive may be further used in the previous example to further increase tightness of fit.

Figure 4:
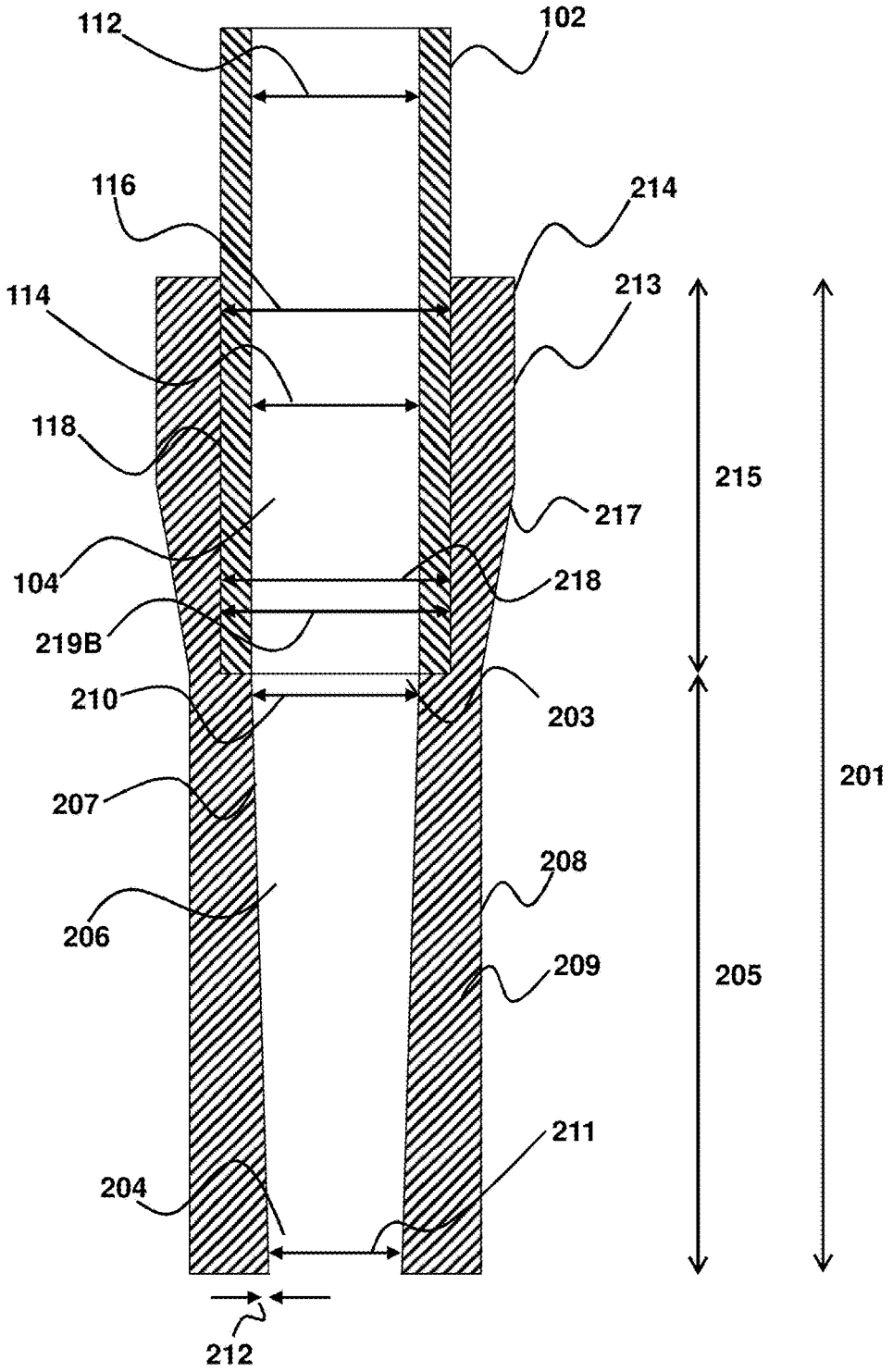
FIG. 4 is a cross-sectional illustration showing a portion of a muzzle portion of a disrupter barrel and an exemplary adapter having a taper.

FIG. 4 illustrates an exemplary adapter 200 operably connected to barrel 102 at muzzle end 104. Adapter 200 is, for example, pressure fit by sliding connector 213 over muzzle end 104 and a clamp (not shown) may be tightened over connector 213 to increase tightness of fit. FIG. 4 shows adapter 200 having a taper 212. Taper 212 may be described by an angle (e.g., 1° or more, 5° or less, or between 1° and 5°), a length, and/or a ratio of inner diameters (e.g., ratio of first end inner diameter to second end inner diameter). For visual clarity, FIG. 4 illustrates taper 212 by the difference in radii between the first end inner radius and the second end inner radius dimensions.

Longitudinal region wall thickness 226 may be uniform or non-uniform over length 205 of longitudinal region 202. For example, wall thickness 226 is non-uniform where longitudinal region inner diameter changes while longitudinal region outer diameter remains unchanged. For example, wall thickness 226 is non-uniform where longitudinal region outer diameter changes while longitudinal region inner diameter remains unchanged (e.g., if outer surface 208/outer diameter is configured to include a taper such as illustrated in FIGS. 1-3). For example, wall thickness 226 is non-uniform where the inner and outer diameters of longitudinal region 202 both change by different amounts.

The entirety of adapter 200 may be formed of a single material or combination of materials (e.g., entire adapter 200 is formed of stainless steel). Any one or a more elements of adapter 200 (e.g., connector 213 or nut 224) may be formed of a different material or different combination of materials than are other elements of adapter 200. For example, longitudinal region outer surface 208 may be at least partially formed of a different material than substantially the remainder of adapter 200. For example, outer surface 208 may include a partial or full coating, such as a coating configured to increase heat dissipation, formed of a different material than are other elements of adapter 200 (e.g., stainless steel). Adapter 200 may be uniformly or non-uniformly formed of one or more metals (e.g., stainless steel or aircraft aluminum), one or more ceramic materials (e.g., alumina), one or more polymer or plastic materials, carbon fiber, or of any combination of these.

Longitudinal region length 205 may between 20% and 200% of fluid-projectile length 302. Length 205 may be empirically determined for any disrupter system according to disrupter 100 parameters (e.g., length and cartridge 122 characteristics) and/or fluid projectile parameters (e.g., composition). Fluid projectile length 302 may be substantially equivalent to barrel length 110 (e.g., FIGS. 2-3). Fluid projectile length 302 may be less than barrel length 110 (e.g., FIGS. 8-9). Additionally, for example, any of taper 212, wall thickness 226, and composition material(s) in adapter 200 may be empirically determined for any disrupter system according to disrupter 100 parameters, fluid projectile parameters (e.g., composition), and/or desired improvement in target disruption parameters (e.g., fluid jet length, impact pressure, reverse fluid jet velocity, etc).

Figure 5:
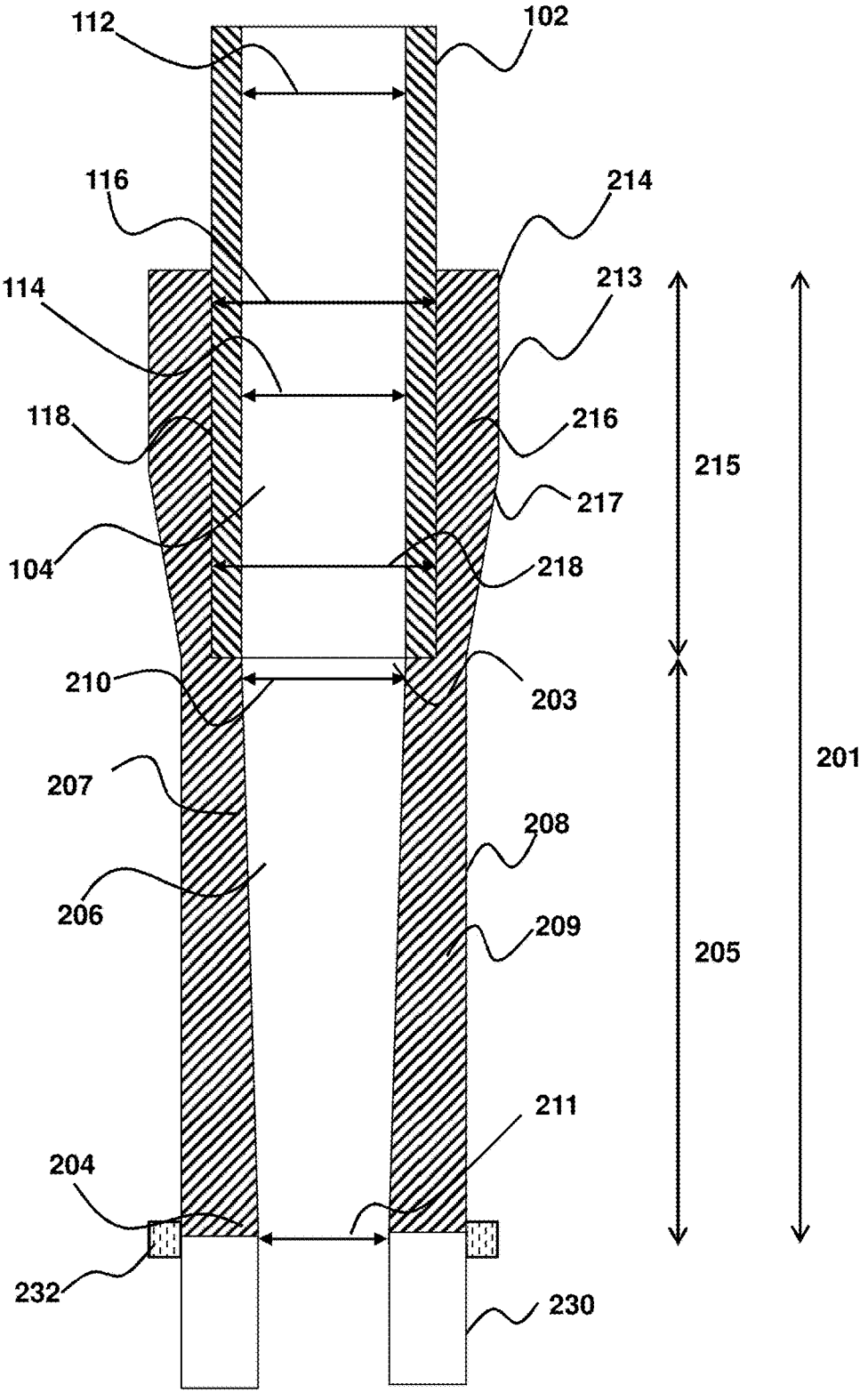
FIG. 5 is a cross-sectional illustration of the disrupter and adapter of FIG. 4, wherein the adapter further includes an accessory (e.g., a suppressor).

FIG. 5 illustrates adapter 200 further including an accessory 230 and an accessory connector 233 at second end 204. For example, accessory 230 may be a Venturi tip, a suppressor, or a combination thereof. For example, FIG. 5 illustrates an accessory 230, such as a suppressor, connected to adapter 200 by accessory connecter 232. The accessory may connect to the second end by a threaded outer surface 240 configured to receive the accessory. The suppressor may have a chamber between the inner lumen and outer surface and passages sized to allow high pressure gasses to enter the chamber, but substantially no fluid.

Figure 6:
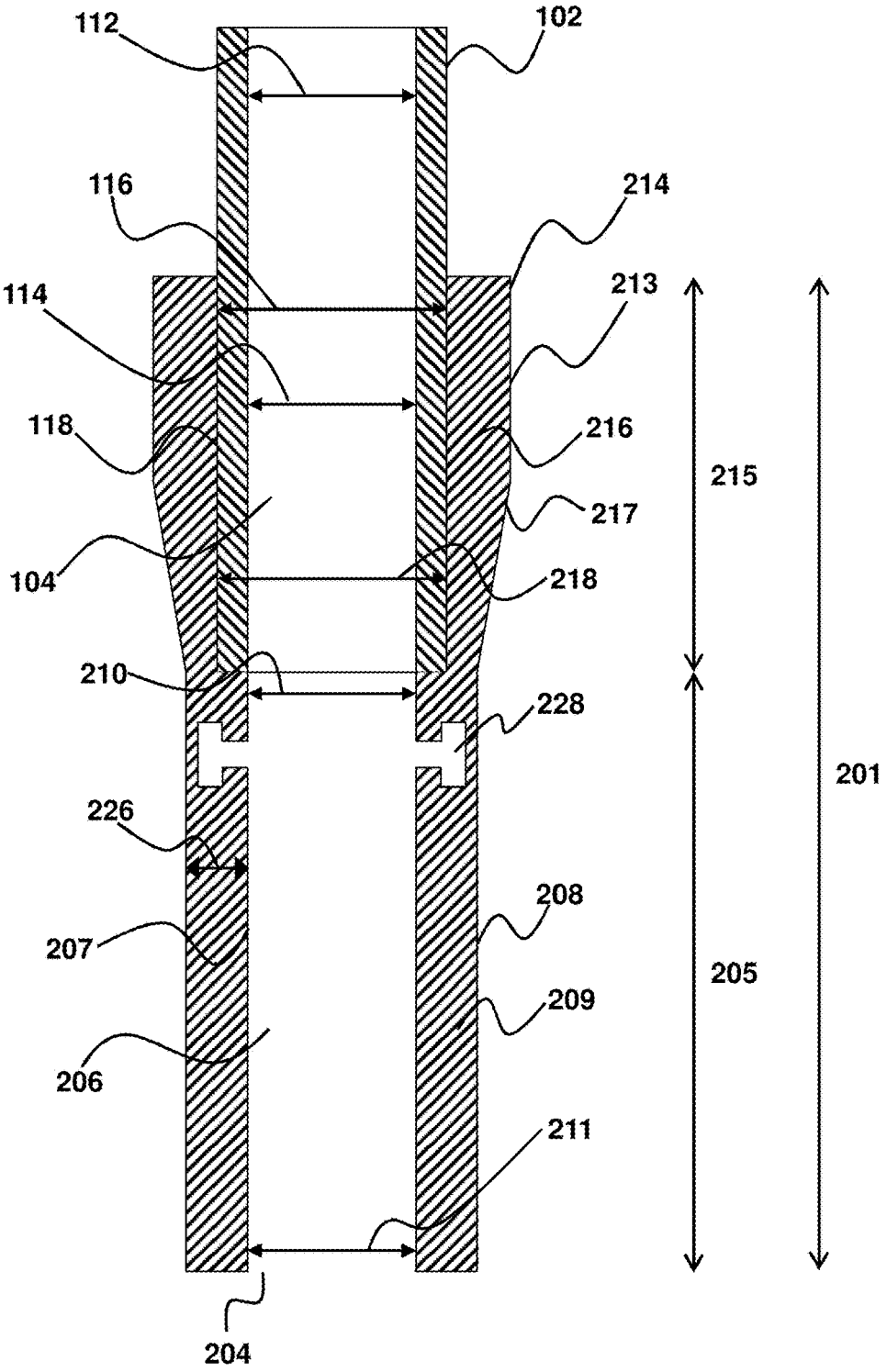
FIG. 6 is a cross-sectional illustration showing a portion of a muzzle portion of a disrupter barrel and an exemplary adapter having recess features in the longitudinal region lumen.
Figure 7:
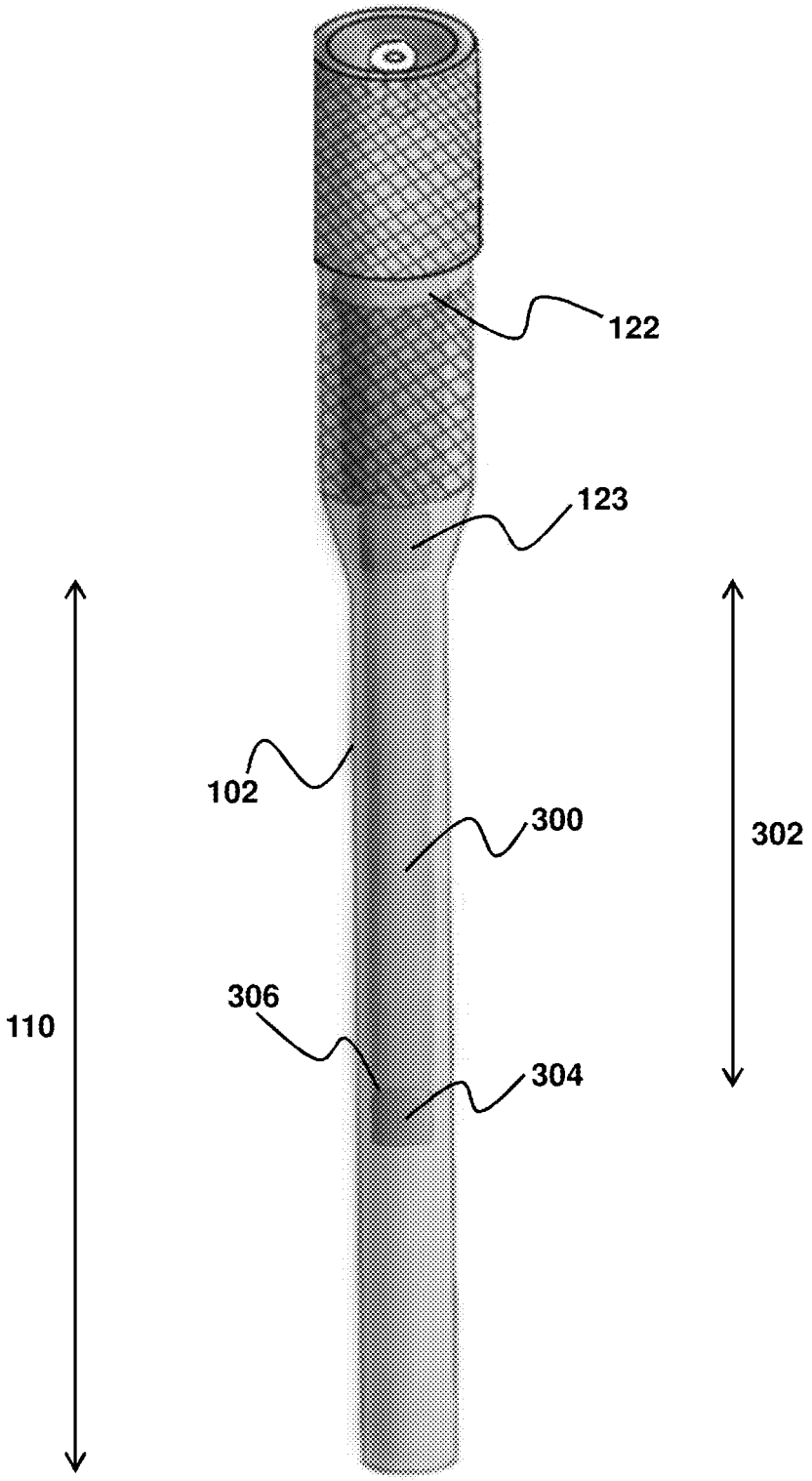
FIG. 7 is an illustration showing a portion of a disrupter with a fluid projectile therein, wherein the fluid projectile length is less than the disrupter barrel length.
Figure 8:
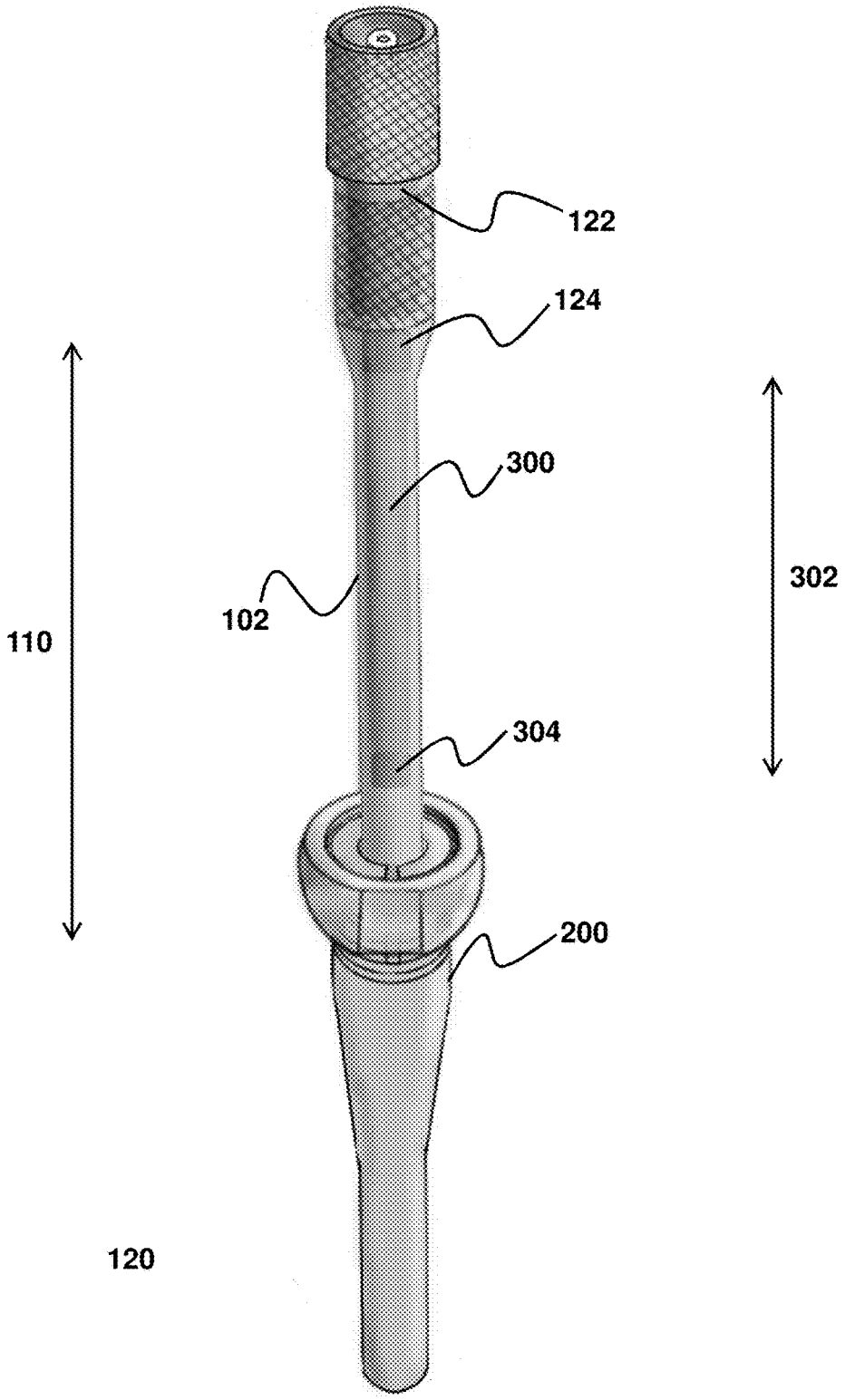
FIG. 8 is an illustration showing the disrupter and projectile of FIG. 7 with an exemplary fluid jet enhancement adapter operably connected thereto.

FIG. 6 illustrates adapter 200 having recess feature 228 within longitudinal region 202. Recess features 228 may be fully or partially radially configured within the lumen of longitudinal region 202. Adapter 200 may include one or more recess features 228. Recess features 228 do not expose the lumen to the surrounding environment. In other words, recess features 228 are configured such that substantially none of the fluid of fluid projectile 300 exits adapter 200 except at second 204 (or, except through accessory 230, if present).

Figure 9:
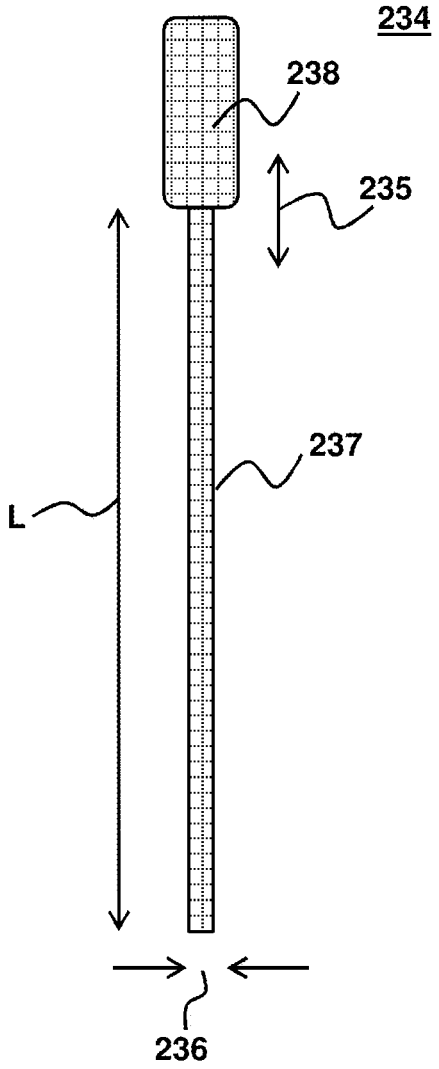
FIG. 9 is a schematic of a rammer.

FIG. 9 illustrates an exemplary rammer 234, the rammer having width 236 and length L, with the smaller diameter ramming body 237 configured to insert into lumen at a length L. Adapter 200 may include rammer 234 in order to control or adjust the fluid projectile length and/or apply plug 304 before and/or after adapter 200 is operably connected to barrel 102. The length, L, may be configured to be user-adjustable, including by a telescoping connection 239 of adjacent sections of ramming body 237, or between ramming body 237 and handle portion 238.

The adapters described herein may include any combination of features and/or elements of adapters 200, including any of those illustrated in FIGS. 1-9 and FIGS. 11-16, as well as any of the functional benefits described above.

Figure 10:
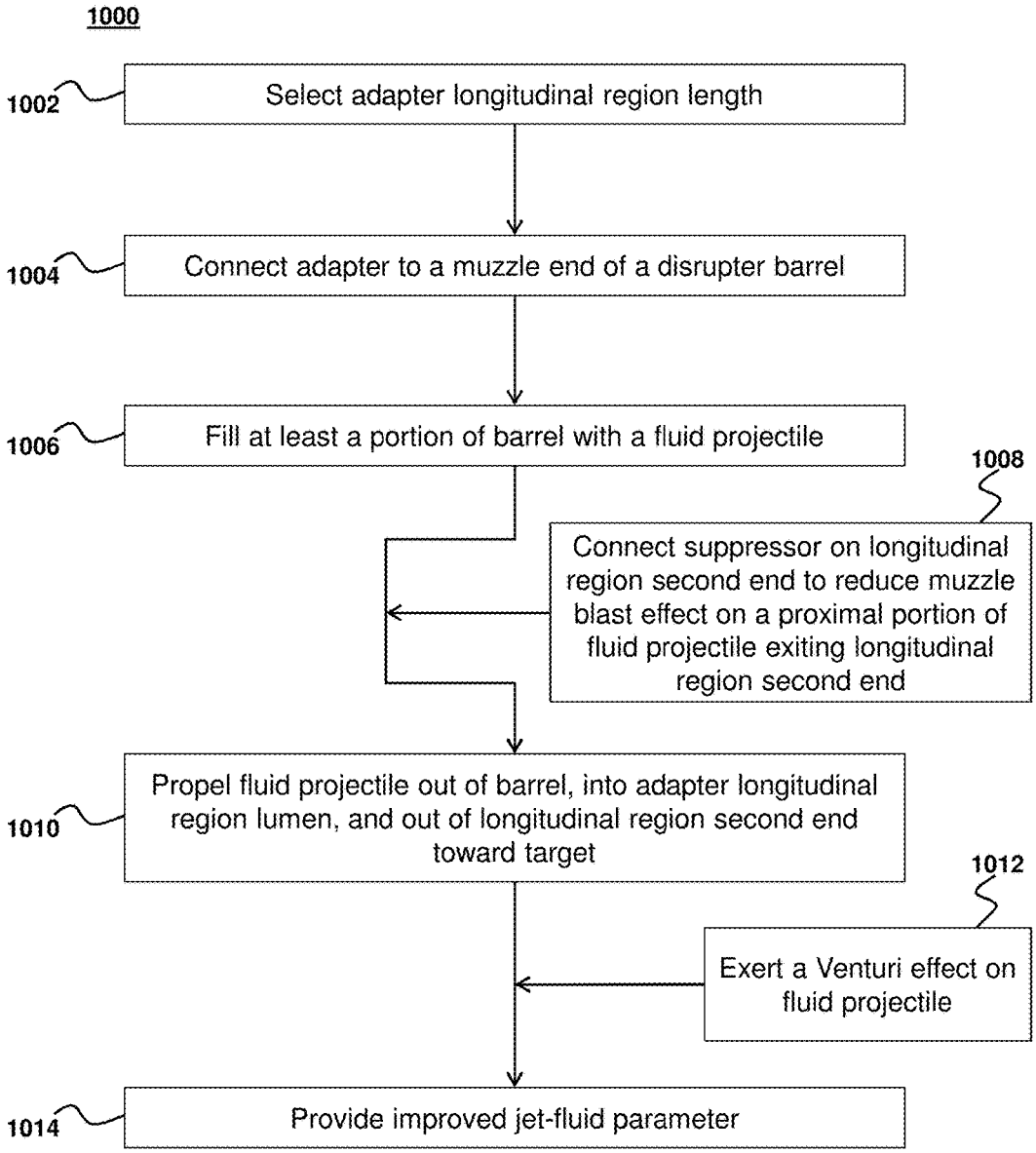
FIG. 10 is a flow chart summary of a method for reducing a reverse jet velocity gradient in a liquid projectile ejected from a disrupter.
Figure 11:
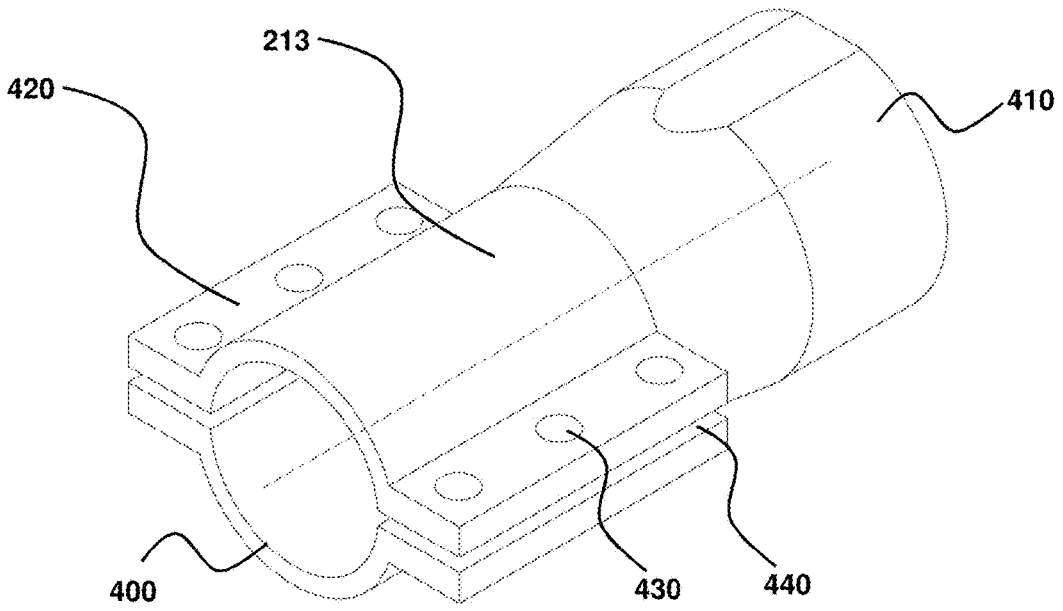
FIG. 11 is a perspective view of a connector for securing any of the RevJet adapters provided herein to a disrupter barrel.
Figure 12:
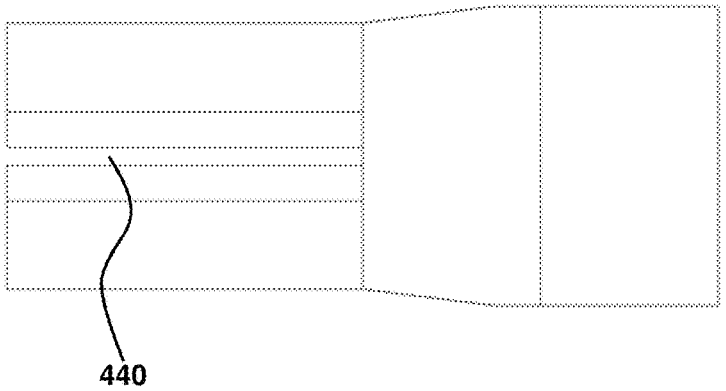
FIG. 12 is a side view of the connector of FIG. 11, illustrating a gap between the top and bottom portions of the proximal end of the connector that may be securably tightened with fasteners that force the top and bottom portions against a disrupter barrel. The distal portion of the connector connects to the proximal end of the adapter.
Figure 13:
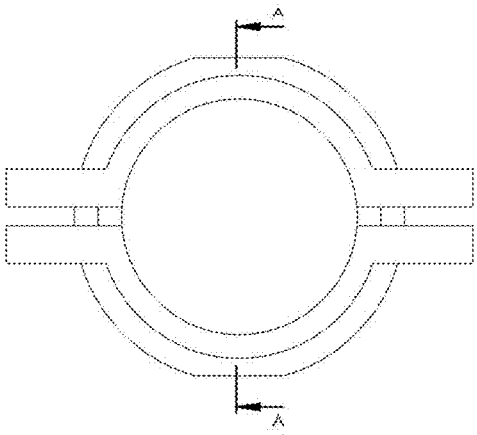
FIG. 13 is an end view of the connector of FIGS. 11-12.

FIG. 10 is a flow chart summary illustration an exemplary method 1000 for improving jet-fluid parameters such as reducing a reverse jet velocity gradient in a fluid jet projectile ejected from a disrupter. In optional step 1002, longitudinal region length 205 is selected based on fluid projectile length 302. Other elements beside longitudinal region 202 may be inseparable from adapter 200, in which cases selecting longitudinal length 205 means selecting adapter 200 having the desired or needed longitudinal region length 205 according to disrupter 100 parameters (e.g., length and cartridge 122 characteristics) and/or fluid projectile parameters (e.g., composition). In step 1004, adapter 200 is operably connected to muzzle end 104 of barrel 102 of adapter 100. An operable connection between adapter 200 and muzzle end 104 may include any one or a combination of compatible connection mechanisms, optionally via connector 213, which may optionally be the exemplary connector 213 illustrated in FIGS. 1-3 (e.g., having collet 222). In step 1006, at least a portion of barrel 102 is filled with fluid projectile 300. For example, step 1006 may include filling of a fluid into barrel 102, followed by plugging the fluid using plug 304, optionally employing a ramrod such as rammer 234. Alternatively, step 1006 may include inserting an encapsulated fluid projectile 300 such as a HEET fluid projectile into barrel 102. In optional step 1008, accessory 230 is operably connected to longitudinal region second end 204. For example, a suppressor is operably connected to longitudinal region second end 204 to reduce muzzle blast effect on a proximal portion of the fluid projectile exiting at the longitudinal region second end 204. Alternatively, the suppressor may be incorporated with the RevJet adapter instead of attaching to the adapter. In step 1010, fluid projectile 300 is propelled out of barrel 102, into longitudinal region 202 of adapter 100, and outer of longitudinal region second end 204 toward a target explosive device. In optional step 1012, a Venturi effect is exerted on the fluid projectile as it is propelled through longitudinal region lumen 206 and out of longitudinal region second end 204. In step 1014, an improved jet-fluid parameter is provided via use of adapter 200 with disrupter 100. See above for examples of jet-fluid parameter improvement.

The invention can be further understood by the following non-limiting examples.

Example 1: ReVJeT Adapters for Disrupter Enhancement

Any of the fluid jet enhancement adapters disclosed herein may be referred to as a Reverse Velocity Jet Tamper ("ReVJeT") disrupter enhancer. The ReVJet is used to improve effectiveness of propellant driven disrupters in the defeat of improvised explosive devices (IEDs). The ReVJeT stabilizes a fluid jet improving efficiency with respect to standoff, and improves target penetration and impulse. ReVJeT reduces the risk of shock initiation of explosives. ReVJeT makes it feasible to use disrupters to create breaching access in other types of targets such as walls, windows, doors, vehicle bodies, and windshields with minimal hazard to persons on either side of the breach zone.

Fluid jets are used to defeat IEDs by penetrating barriers and, through inertial transfer, disable an IED. The ReVJeT is a tubular extension which can be attached to the muzzle of a fluid filled barrel that causes the jet tip to accelerate and the back end of the jet's acceleration to be hampered: the result is a normalized velocity over the jet length. The fluid jets of current systems are limited in jet free flight and quickly break up by atomization. The ReVJeT can improve fluid jet performance by up to 800% at greater standoffs. The ReVJeT may increase penetration into a target by at least 1.5 times at nominal standoffs because the fluid column remains intact and does work on the target longer. In one test method, the ReVJeT has shown to have similar penetration to explosively driven mass-focusing shaped charges. In addition, the ReVJeT reduces impact pressure with respect to time such that it will not, or is less likely to, shock initiate sensitive explosives, to include flash powder.

The Percussion Actuated Non-electric (PAN) disrupter is the most widely used propellant driven disrupter used by public safety bomb technicians and explosive ordnance disposal (EOD) operators in the United States. The PAN and many similar disrupters can fire solid projectiles and also drive water at high velocity to penetrate barriers and transfer momentum to disable fuzing systems and open and disperse the contents of an IED. As a result, these gun-type disrupters are commonly referred to as water cannons. There are many disrupters on the market with varying barrel length and caliber (12 gauge is most common) and thus have different water column lengths and diameter. Some of these disrupters are designed with short barrels and it has been established they produce unstable water jets which atomize too quickly and are ineffective at defeating IEDs. They also require dramatically closer stand-off distances compared to full-size disrupters. The inventors have established the cause of the inefficiencies in disrupters, particularly short barreled disrupters.

Generally, to load a disrupter, the fluid, most commonly water, is poured down the barrel and completely fills the barrel. The barrel is sealed by inserting plugs in the breech and muzzle. An explosive cartridge, typically a shotgun shell, is inserted into the breech. The explosive cartridge does not contain a projectile and is known as a blank cartridge. Blank cartridges can vary in strength, and increased strength cartridges cause higher jet velocities. The explosion produces rapidly expanding hot gases which pressurize the disrupter chamber and push the water out of the barrel at high velocity.

Driving a fluid by explosively expanding gases results in several factors which cause a fluid jet to atomize that are not observed with jets produced by non-explosive systems such as in water fountains. The explosion in breech produces a shock wave that propagates down the water column. Due to shock impedance mismatches, the waves rarefact at the water-gas interfaces and move back and forth in the water column thus creating tensor and compressive stresses. As pressure waves collide inside the jet, they cause hoop stress on the water. When the column forms a jet outside the barrel, the pressure waves cause the water to expand radially and because water cannot withstand hoop stress it atomizes. High speed video reveals rings of atomized water spray propagating down the central axis of the disrupter jet.

An additional factor which causes the jet to break up is due to the water jet reverse velocity gradient. This phenomenon was identified using flash X-ray imagery. Because the water behaves approximately as an inviscid fluid, the water is accelerated mostly only while it is in the barrel. The initial water coming out of the barrel is at low velocity and the water behind it is accelerated for a longer period in the barrel and is at higher velocity. The jetting water has a continuum or gradient of increasing velocity from the jet tip to tail. For simplicity of explanation and analytical modeling, the water column can be treated of as being made up of discrete water elements each traveling at increasing velocity as one moves rearward in the water column. The previous flash X-ray work showed the jet tip has a "mushroom" or "jelly fish" shape. It was thought that the jet tip mushrooming was due to air drag and the fluid-fluid interaction with air that eroded the jet from the front to the rear. The observed results revealed a growing jet tip velocity as the slower water is dispersed. Increasing the disrupter distance from the target, the impact pressure also increases. The impact pressure can be approximated to have a velocity squared dependence. If the pressures are too high, the precursor shock wave through the barrier or impact with the explosives can cause an explosive reaction inside the IED.

One interpretation theorized that the rearward water would overtake the water in front of it and contribute to the increasing jet velocity. This is likely not the case as will be explained below.

Computational modeling and previous flash X-ray shows that the jet length shrinks in free flight as the faster water overtakes the water in front of it. CTH modeling indicated the rearward water elements pushing on the water in front causes the water to atomize radially because it cannot withstand the hydrodynamic stress. Tracers in the model show the water in the rear does not overtake the water in front—rather it destroys the jet as it propagates. The consequence of a shrinking jet is the duration of loading is reduced and penetration within the target drops because penetration is proportional to jet length.

The ReVJeT characterization reveals the fluid jet tip erosion and the characteristic "jelly fish" shape of the fluid tip is predominantly due to the reverse velocity gradient and not air drag. We propose each element of water pushes into the one in front and causes it to be pushed out of the way radially. High speed video shows the ReVJeT greatly reduces the "jelly fish" shape despite the fact that the fluid nose is moving at nearly double its velocity without ReVJeT. The theoretical effects of air drag on jet erosion is examined. The calculations only factor in air drag, and assumes a laminar flowing normalized water jet, the jet should propagate at least six times farther than the observed distance. If this calculation showed a distance similar to observation, then air drag would be an important consideration. We accordingly conclude that air drag erosion is not a major factor in the jet destabilization.

There are two additional factors of note that contribute to fluid jet atomization. A Reynolds number calculation predicts that water flow within the barrel is highly turbulent and this turbulence causes an unstable jet outside the barrel. Without giving up velocity needed for work on a target, the only way to reduce the turbulence is to significantly reduce the barrel diameter. This is impractical because the loss of jet mass and diameter would cause a huge drop in impulse and displacement of material inside the bomb. The likelihood of the jet interacting with internal IED structures would be low and it would defeat the purpose of using a fluid for general disruption of IEDs. Furthermore, excessive velocities may occur if the same blanks were used. The last factor that will be discussed is the muzzle blast and shock due to the hot gases traveling faster than the fluid. It is obvious from high speed video that the muzzle blast further accelerates the rear of the jet and causes the end of the jet to fan out radially. Our data also indicates the muzzle blast also transmits a shock through the jet and negatively effects the jet tip.

U.S. Pat. No. 6,896,204 B1 ("Greene") proposes to retard the acceleration of the rear of a water column in order to preserve the jet at longer standoffs. Greene describes a disrupter adapter that contains gas ports at the junction with the barrel. The Greene adapter has an abrupt widening of the diameter at the zone containing the gas ports. The intent was to use the Venturi principle to slow down the water. A Reynolds number calculation would predict an increase in water turbulence caused by the larger diameter in this region. The ReVJeT, in contrast, does not have an abrupt change in diameter and does not have gas ports at the junction with the disrupter muzzle. Gas ports will cause a sudden drop in pressure which would dramatically cause a drop in disrupter performance at nominal standoffs because the average jet velocity is an important parameter in access and disablement of a bomb. Greene describes the adapter as having varied diameter and the length being equal to the water column. That design, however, would greatly reduce the average velocity of the water jet for a given blank cartridge and the length of the adapter is fixed and not tuned to the disrupter system. As explained below, there is an optimum ratio of ReVJeT length to fluid column length. The wrong ratio can be detrimental to disrupter performance and must be empirically determined for each disrupter system. The ReVJeT greatly reduces the reverse velocity gradient without sacrificing average jet velocity.

A method of producing a ReVJeT system is to fill the entire disrupter barrel with an encapsulated fluid and then attach a ReVJeT adapter to the end of the barrel. The ReVJeT adapter is a tube with the same diameter as the disrupter barrel at the junction with the barrel and a length specific for the disrupter system. The tube extension allows the tip of the water column to accelerate under confinement and the back end of the water column's acceleration is limited by several variables which will be explained in the following paragraphs. The end result is a normalized water jet with a high average velocity that we have shown will outperform the same disrupter system without ReVJeT at any standoff and not cause shock initiation of common explosives found in IEDs. The disrupter without ReVJeT was shown to shock initiate some of these explosives. Three disrupter systems from different manufacturers are used in our tests. The disrupters had varying fluid column lengths and used different blank cartridges.

The sustained mass of the flowing water column inside the combined barrel and ReVJeT adapter causes a lower velocity at the jet rear due to the velocity's inverse square root dependence with respect to mass inside the extended barrel. Furthermore, water is not truly inviscid so the water that has exited the barrel is contributing to the drop in acceleration.

The internal barrel pressures drop with distance from the breech due to heat loss, gas expansion and fluid shear forces. Cooling of the hot expanding gases occurs through conductive heat transfer with the barrel and ReVJeT. The added ReVJeT shear forces have a greater influence toward the rear of the fluid column. As the gas expands from the breech, the ideal gas law predicts the work on the fluid column decreases approximately logarithmically. The opposing fluid shear stress further reduces the work on the fluid column. The ReVJeT adapter causes additional shear stress which is a function of the fluid viscosity and is proportional to the fluid velocity. Since the fluid at the rear is moving more quickly and is interacting with the disrupter and ReVJeT walls longer, the shear force produces negative feedback on rear of the fluid to drop the pressure and slow its flow. The pressure loss is directly proportional to the length of the barrel plus the ReVJeT extension as predicted by the Darcy-Weisbach equation. Additional pressure loss may be caused by fluid adhesion with the barrel walls. In the case of HEET fluids which can be composed of long chain polymers often have strong adhesive properties. The result of these forces is a normalized velocity over the jet length with a critical average velocity that enables the jet to perforate common IED casings/containers and provides the necessary impulse to disperse the IED's explosives and destroy internal components. Further, the normalized velocity does not ramp up the impact pressure as previously noted for jets not tamped by ReVJeT. Explosive impact dynamics tests with ReVJeT showed no reaction with common IED explosives including flash powder.

Another additional benefit of ReVJeT is the damping out of the rarefaction waves. The barrel extension causes the fluid to remain confined for a longer period of time. During the fluid's confinement, the rarefaction waves reflect back and forth through the water column and due to energy losses the amplitude should decrease exponentially, similar to a pressure wave produced in a rod. Some of the pressure wave amplitude damping may occur due to barrel harmonics and the impedance mismatch of a dissimilar metal used to make the ReVJeT. We demonstrate the ReVJeT's ability to eliminate the rarefaction waves. In these experiments, we use a viscous fluid in place of water and removed a percentage of the fluid column from the barrel to produce the ReVJeT behavior. The fluid jet showed almost laminar flow, no "jelly fish" shaped tip, and no rarefaction waves as it exited the barrel.

Alternative methods can be used to improve some fluid jet parameters. A simple method is not filling the entire barrel with fluid, thereby leaving a distal portion of barrel void of fluid. Another option is to combine a smaller extension and reduce the amount of fluid removed from the barrel to create the required optimum length of empty tube. In both methods, a ram rod can be used to quickly displace the desired amount of water and also seat the muzzle plug. The disadvantage of these methods is a shorter jet length, however, we have shown the mass reduction will cause higher average velocities for a given blank cartridge and enable the jet to penetrate thicker or tougher material barriers.

The ratio of tube length to fluid column length is important to maintain disrupter performance for a given fluid, disrupter barrel, and cartridge. We empirically determine that the optimal ReVJeT adapter length can be between 40% and 150% of the fluid column. A typical full-sized disrupter can have a fluid column as long as 22" and short barreled disrupters can have fluid column lengths as short as 7". The short barreled disrupter water jets will experience considerably higher reverse velocity gradients because they use cartridges of the same strength as the full-sized disrupters. Regardless of the disrupter used, the fluid closer to the muzzle end will always have an initial velocity close to zero. The reduced projectile mass will cause the velocity of the fluid column rear to be considerably higher than a full-sized disrupter which holds up to 2.5 times the mass. The rarefaction waves are also more violent in short barreled disrupters. The result is the necessity for a higher ratio of ReVJeT to fluid column length for smaller disrupter systems in order to normalize the water velocity. The inventors determined the optimal lengths for the ReVJeTs through testing. We have empirically determined that the non-optimal ratio of ReVJeT length to fluid column length can be detrimental to the fluid jet's performance with respect to impulse, barrier penetration, and cavitation. The ReVJeT must be optimized to the specific disrupter system defined by the projectile fluid, blank cartridge, and barrel dimensions.

The ReVJeT can be further enhanced by slightly tapering the barrel diameter or by putting specialized tips on its end. A slight taper in inner diameter would produce a Venturi effect and increase the average jet velocity. As an option, the ReVJeT can have a threaded end to connect different tips to produce a variety of effects. For example, a Venturi tip can be attached to the ReVJeT extension instead of tapering its diameter to increase jet velocity, and more importantly jet length for a given volume of fluid. This would be of benefit for shorter fluid columns. A suppressor can be placed on the end of the ReVJeT to reduce muzzle blast effects on the rear of the exiting jet.

Example 2: Connecter

Figure 14:
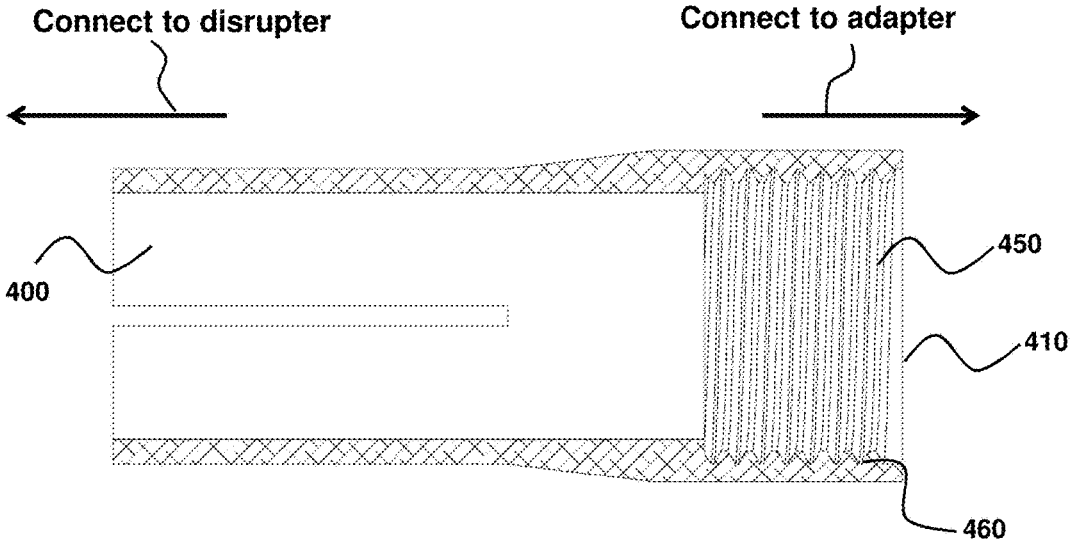
FIG. 14 illustrates a cut-away through section A-A of FIG. 13, with threaded end for rotationally connecting to a correspondingly threaded section of an outer surface of adapter proximal end. The proximal end of connector has a gap for receiving a disrupter barrel, where the connector proximal end can be tightly secured against an outer surface of the disrupter barrel.
Figure 15:
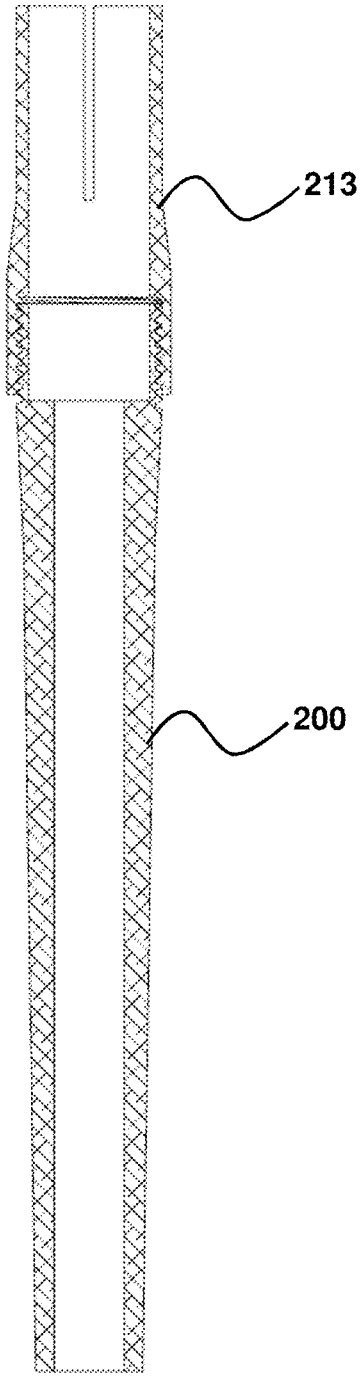
FIG. 15 illustrates an adapter connected to the connector, and ready to receive a disrupter barrel.
Figure 16:
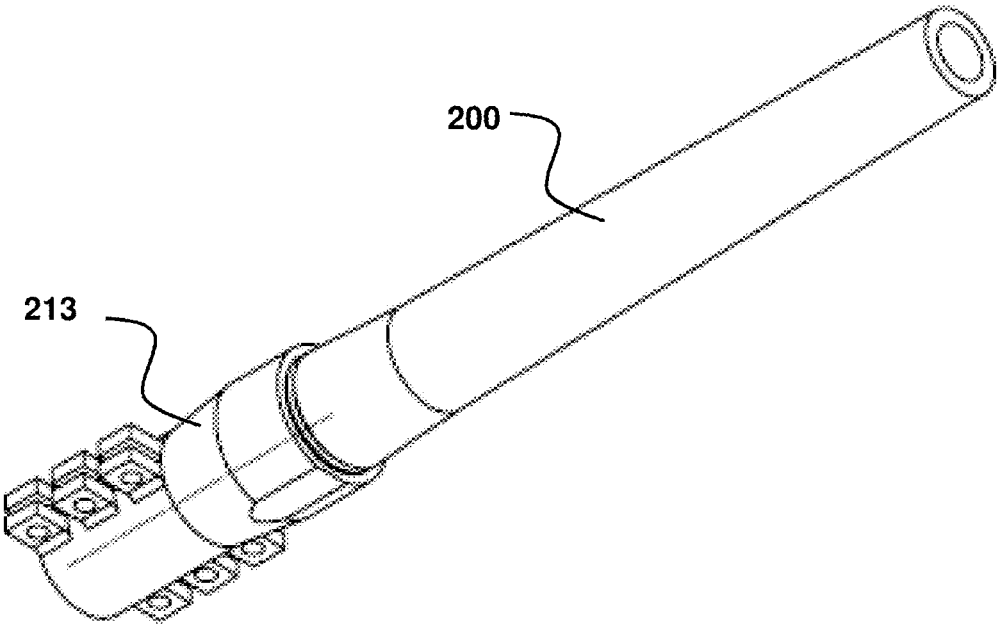
FIG. 16 is a perspective view of a connector and adapter.

Other connecter 213 configurations are illustrated in FIGS. 11-16. The connectors may be used to connect any of the adapters described herein to a conventional disrupter. FIGS. 15-16 illustrate connecter 213 connected to adapter 200.

Connector proximal end 400 is configured to connect to disrupter barrel outer surface. Connector distal end 410 is configured to connect to adapter threaded outer surface. This is illustrated in FIG. 14. The connector may have a connector clamp 420 to facilitate reliable tight-fit against the disrupter outer barrel surface distal end. This tight fitting can be reliably, efficiently, and quickly achieved by use of fasteners (not shown) through connector fastener passages 430 that, when tightened, decreases connector clamp gap 440, to provide compressive fitting between adapter and disrupter barrel outer surface. In this manner, no special machining of disrupter barrel outer surface is required to "retrofit" disrupter barrel with any of the adapters provided herein.

Connecter distal end 410 may have threads 450 on an internal surface 460 to rotationally mate with adapter having corresponding threads on an outer surface of the adapter proximal end.

Example 3: ReVJeT Improved Fluid Jet Parameter

Figure 17A:
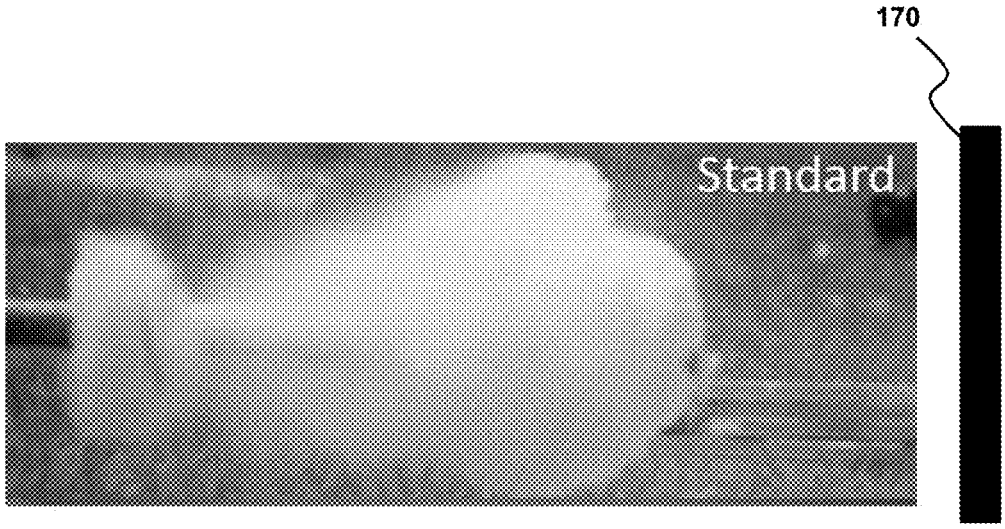
FIGS. 17A and 17B are high speed video frame grabs of a conventional disrupter only and the same disrupter with an adapter of the present invention after fluid jet discharge, respectively. The pictures illustrate the improvement in jet characteristics when the adapter is used. The disrupter is a standard PAN setup, water filled 21.75" bore. The adapter has the same set-up, including same propellant load, but with a 10" ReVJeT adapter connected to the distal end of the disrupter barrel.
Figure 17B:
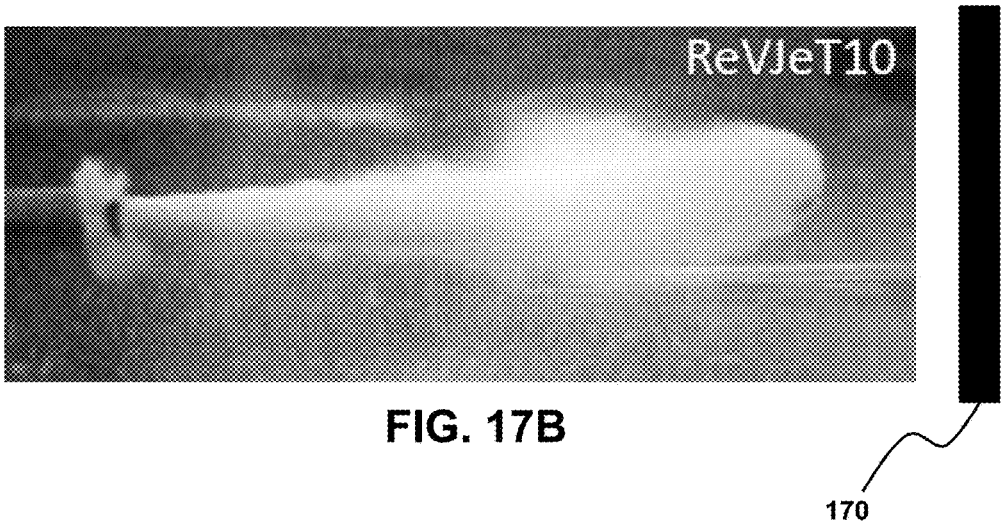

FIGS. 17A-17B are photographs that explicitly illustrate improved fluid jet characteristics when an adapter is connected to the disrupter (FIG. 17B) compared to the same disrupter without the disrupter (FIG. 17A labelled "Standard"). The ReVJeT has more well-defined jet column, with a much less atomization and rarefaction wave indication. The jet-tip of FIG. 17B remains well-defined, and continues to travel in a mainly longitudinal direction, providing improved barrier-defeating capability compared to the dispersing fluid jet tip illustrated in FIG. 17A. The fluid jet is expelled from the disrupter or adapter and travels toward a target 170. The improved jet from the ReVJet accordingly provides better work on target with correspondingly improved penetration and work in a target interior. Functionally, this results in rapid and reliable disruption of the target interior and associated reliable disarming of explosive devices such as IEDs.

One reason for the fluid-jet improvement is the change in fluid velocity gradient between the distal and proximal jet ends. Without the adapter of the instant invention, the rear of the jet is at least about 155% faster or 128% faster than the front of the jet. In contrast, use of ReVJeT adapter constrains the rear of the jet to be no more than about 15% faster than the front, with even smaller differences achieved by appropriate selection of HEET fluid, including having solid particles suspended in the proximal portion of the fluid.

TABLE 1

Element Identification Numbers

| Item Number | Item Description |
|---|---|
| 100 | propellant driven disrupter |
| 102 | disrupter barrel |
| 104 | muzzle end |
| 105 | Distal portion of barrel |
| 106 | breech end of barrel |
| 108 | Breech |
| 110 | length of barrel |
| 112 | Barrel lumen diameter |
| 114 | Inner diameter at muzzle end of barrel |
| 116 | Outer diameter at muzzle end of barrel |
| 118 | Outer surface at muzzle end of barrel |
| 120 | Surrounding environment |
| 122 | Explosive cartridge |
| 124 | Proximal end of (HEET) fluid |
| 200 | Adapter |
| 201 | Adapter length |
| 202 | Longitudinal region |
| 203 | First end of longitudinal region |
| 204 | Second end of longitudinal region |
| 205 | Length of longitudinal region |
| 206 | Longitudinal region lumen |
| 207 | Longitudinal region inner surface |
| 208 | Longitudinal region outer surface |
| 209 | Longitudinal region wall |
| 210 | Longitudinal region lumen first end inner diameter |
| 211 | Longitudinal region lumen second end inner diameter |
| 212 | Longitudinal region lumen taper |
| 213 | Connector |
| 214 | Proximal region of adapter with connector |
| 215 | Length of connector/proximal region of adapter with connector |
| 216 | Connector inner surface/inner surface of proximal region of adapter with connector |
| 217 | Connector outer surface/Outer surface of proximal region of adapter with connector |
| 218 | Inner diameter of proximal region of adapter with connector |
| 219A | A. Resting Proximal Diameter (inner) |
| 219B | B. Proximal Lumen Diameter (inner) |
| 220 | Threads or grooves on outer surface of proximal region of adapter with connector |
| 221 | Kerf cut at proximal region of adapter with connector |
| 222 | Collet |
| 224 | Nut |
| 225 | Inner threads of nut |
| 226 | Wall thickness at longitudinal portion |

TABLE 1-continued

| Element Identification Numbers | |
|---|---|
| Item Number | Item Description |
| 228 | Recess features in longitudinal region lumen/inner surface |
| 230 | Fluid-jet accessory |
| 232 | Accessory connector |
| 234 | Rammer |
| 235 | Rammer telescoping connection |
| 236 | Rammer width |
| 237 | Rammer body |
| 238 | Rammer handle portion |
| 300 | Fluid projectile |
| 302 | Fluid projectile length |
| 304 | Cap or plug |
| 306 | Distal end of fluid projectile |
| 400 | Connector proximal end (connect to disrupter barrel outer surface) |
| 410 | Connector distal end (connect to adapter threaded outer surface) |
| 420 | Connector clamp |
| 430 | Connector fastener passages |
| 440 | Connector clamp gap |
| 450 | Connector threads |
| 460 | Connector inner surface |

STATEMENTS REGARDING INCORPORATION BY REFERENCE AND VARIATIONS

All references throughout this application, for example patent documents including issued or granted patents or equivalents; patent application publications; and non-patent literature documents or other source material are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention. The specific embodiments provided herein are examples of useful embodiments of the present invention and it will be apparent to one skilled in the art that the present invention may be carried out using a large number of variations of the devices, device components, methods and steps set forth in the present description. As will be obvious to one of skill in the art, methods and devices useful for the present embodiments can include a large number of optional device components, compositions, materials, combinations and processing elements and steps.

Every device, system, combination of components or method described or exemplified herein can be used to practice the invention, unless otherwise stated.

When a group of substituents is disclosed herein, it is understood that all individual members of that group and all subgroups, including any device components, combinations, materials and/or compositions of the group members, are disclosed separately. When a Markush group or other grouping is used herein, all individual members of the group and all combinations and subcombinations possible of the group are intended to be individually included in the disclosure.

Whenever a range is given in the specification, for example, a number range, a flow-rate range, a size range, a pressure range, a velocity range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements and/or limitation or limitations, which are not specifically disclosed herein.

One of ordinary skill in the art will appreciate that compositions, materials, components, methods and/or processing steps other than those specifically exemplified can be employed in the practice of the invention without resort to undue experimentation. All art-known functional equivalents, of any such compositions, materials, components, methods and/or processing steps are intended to be included in this invention. The terms and expressions which have been employed are used as terms of description and not of limitation, and there is no intention in the use of such terms and expressions of excluding any equivalents of the features shown and described or portions thereof, but it is recognized that various modifications are within the scope of the invention claimed. Thus, it should be understood that although the present invention has been specifically disclosed by examplary embodiments and optional features, modification and variation of the concepts herein disclosed may be resorted to by those skilled in the art, and that such modifications and variations are considered to be within the scope of this invention as defined by the appended claims.

It must be noted that as used herein and in the appended claims, the singular forms "a", "an", and "the" include plural reference unless the context clearly dictates otherwise. Thus, for example, reference to "a layer" includes a plurality of layers and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described.

We claim:

1. A fluid jet enhancement adapter for use with a propellant driven disrupter, the adapter comprising:

a first end operably connected to a muzzle end of a propellant driven disrupter barrel by a connector that connects the adapter first end to the propellant driven disrupter barrel muzzle end;

a second end;

a longitudinal region extending between the first end and the second end;

wherein the longitudinal region has:

a longitudinal region inner surface that defines a longitudinal region lumen;

a longitudinal region outer surface opposably facing the longitudinal region inner surface;

a longitudinal region wall having a wall thickness that separates the longitudinal region inner surface from the longitudinal region outer surface;

the longitudinal region lumen having a first end inner diameter that is substantially equivalent to a muzzle inner diameter;

wherein the longitudinal region wall forms a continuous surface that radially isolates the longitudinal region lumen from a surrounding environment; and wherein the longitudinal region lumen is axially aligned with a disrupter barrel lumen and wherein the adapter longitudinal inner diameter is constant between the first and second ends and equal to the muzzle inner diameter to accommodate expulsion of either liquid projectiles or solid projectiles.

2. The adapter of claim 1, wherein the connector comprises threads or grooves on an inner or outer surface of the disrupter barrel muzzle end and corresponding grooves or threads in a portion of the adapter outer surface or the inner surface.

3. The adapter of claim 1, wherein the connector comprises a collet.

4. The adapter of claim 3, wherein a proximal-most portion of a connector outer surface comprises threads or grooves and a kerf cut and the collet further comprises a nut having an inner threaded surface configured to rotationally mount to the connector outer surface and decrease a proximal lumen diameter.

5. The adapter of claim 4, wherein the proximal lumen diameter is configured to receive a distal portion of the muzzle end.

6. The adapter of claim 5, having a resting proximal lumen diameter that is greater than the first end inner diameter, wherein the resting proximal lumen diameter is configured to accommodate the distal portion of the muzzle end and tighten with the nut to provide the proximal lumen diameter that is substantially equivalent to the muzzle inner diameter.

7. The adapter of claim 1, wherein the connector is configured to retro-fit a conventional disrupter, thereby improving one or more fluid-jet parameters.

8. The adapter of claim 1, wherein the connector comprises:

a connector proximal end having a clamp configured to compressively fit over a disrupter barrel distal end; and a connector distal end having a threaded inner surface configured to rotationally connect to a threaded adapter outer surface.

9. The adapter of claim 1, wherein the longitudinal region has a length that is between 20% and 200% of a fluid-projectile length.

10. The adapter of claim 1, wherein the first end inner diameter is within 10% of a barrel lumen diameter.

11. The adapter of claim 1, having a longitudinal region length selected to reduce a reverse jet velocity gradient, increase penetration depth, increase stand-off distance, and increase average jet velocity.

12. The adapter of claim 1, wherein the second end is configured to receive a fluid-jet accessory.

13. The adapter of claim 12, wherein the second end has a threaded outer surface configured to receive the fluid-jet accessory.

14. The adapter of claim 12, wherein the fluid-jet accessory is a Venturi tip or a suppressor.

15. A fluid jet enhancement adapter for use with a propellant driven disrupter, the adapter comprising:

a first end operably connected to a muzzle end of a propellant driven disrupter barrel;

a second end;

a longitudinal region extending between the first end and the second end;

wherein the longitudinal region has:

a longitudinal region inner surface that defines a longitudinal region lumen;

a longitudinal region outer surface opposably facing the longitudinal region inner surface;

a longitudinal region wall having a wall thickness that separates the longitudinal region inner surface from the longitudinal region outer surface;

the longitudinal region lumen having a first end inner diameter that is substantially equivalent to a muzzle inner diameter;

wherein the longitudinal region wall forms a continuous surface that radially isolates the longitudinal region lumen from a surrounding environment; and a rammer having a diameter and a user-adjustable length to displace a desired amount of fluid from the disrupter barrel and to seat a fluid sealing plug at a distal end of a fluid projectile in the disrupter barrel.

16. A method of reducing a reverse jet velocity gradient in a fluid projectile ejected from a disrupter, the method comprising the steps of:

connecting a first end of a fluid jet enhancement adapter to a muzzle end of a barrel of the disrupter, wherein the adapter comprises:

a second end;

a longitudinal region extending between the first end and the second end;

wherein the longitudinal region has:

a longitudinal region inner surface that defines a longitudinal region lumen;

a longitudinal region outer surface opposite the longitudinal region inner surface; and a longitudinal region wall having a wall thickness that separates the longitudinal region inner surface from the longitudinal region outer surface;

the longitudinal region lumen having a first end inner diameter that is substantially equivalent to a muzzle inner diameter; and wherein the longitudinal region wall forms a continuous surface that radially isolates the longitudinal region lumen from a surrounding environment;

filling at least a portion of the barrel with a fluid projectile;

propelling the fluid projectile out of the barrel, into the longitudinal region lumen and out of the longitudinal region second end in a direction toward a target;

wherein the adapter reduces a projectile fluid velocity gradient in the longitudinal region lumen over the length of the fluid projectile.

17. The method of claim 16, further comprising the step of selecting a longitudinal region length based on a fluid projectile length, wherein the longitudinal region length is between 20% and 200% of a fluid-projectile length.

18. The method of claim 17, wherein the longitudinal region length is empirically determined for each disrupter system and fluid projectile composition.

19. The method of claim 16, wherein the fluid projectile is an encapsulated HEET fluid.

20. The method of claim 16, wherein the fluid projectile has a length corresponding to a length of the barrel.

21. The method of claim 16, wherein the adapter increases the velocity of a distal end of the fluid projectile under confinement in the longitudinal region lumen and decreases acceleration of a proximal end of the fluid projectile relative to the distal end.

22. The method of claim 16, wherein during use a propelled gas and fluid is confined within the longitudinal region lumen until the propelled gas and fluid exit from the longitudinal region second end.

23. The method of claim 16, further comprising the step of exerting a Venturi effect on the fluid projectile in the longitudinal region lumen, thereby increasing average jet velocity and jet length of the fluid projectile exiting the longitudinal region second end.

* * * * *